US006786971B2

(12) United States Patent
Anderson

(10) Patent No.: US 6,786,971 B2
(45) Date of Patent: Sep. 7, 2004

(54) METHOD AND APPARATUS FOR DIGITAL PRINTING

(75) Inventor: Dean Robert Gary Anderson, 1741 N. High Country Dr., Orem, UT (US) 84097

(73) Assignee: Dean Robert Gary Anderson, Orem, UT (US); As Trustee of the D/L Anderson Family Trust ( * ) Notice: Subject to any disclaimer, the term of this patent is extended or adjusted under 35 U.S.C. 154(b) by 0 days.

(21) Appl. No.: 10/165,017

(22) Filed: Jun. 6, 2002

(65) Prior Publication Data

US 2003/0226501 A1 Dec. 11, 2003

Related U.S. Application Data

(63) Continuation-in-part of application No. 10/155,884, filed on May 24, 2002, which is a continuation of application No. 08/878,650, filed on Jun. 19, 1997, now Pat. No. 5,972,111.

(51) Int. Cl.[7] ..... B05C 11/00
(52) U.S. Cl. ..... 118/63; 118/304
(58) Field of Search ..... 118/304, 62, 63, 118/68, 679, 308, 410, 302; 156/436; 347/20–22; 239/214.25

(56) References Cited

U.S. PATENT DOCUMENTS

| | | | | |
|---|---|---|---|---|
| 1,277,632 A | | 9/1918 | Mizener | |
| 2,248,713 A | | 7/1941 | Locke | |
| 2,346,186 A | | 4/1944 | Poesl | |
| 3,082,119 A | | 3/1963 | Harris | |
| 3,619,328 A | * | 11/1971 | Preston | 118/410 |
| 3,779,206 A | | 12/1973 | Sato et al. | |
| 3,805,737 A | | 4/1974 | Miller et al. | |
| 3,977,842 A | | 8/1976 | Mayhew | |
| 4,128,668 A | | 12/1978 | Ernest | |
| 4,259,006 A | * | 3/1981 | Phillips et al. | 118/63 |
| 4,294,408 A | | 10/1981 | Snyder et al. | |
| 4,314,263 A | | 2/1982 | Carley | |
| 4,324,366 A | | 4/1982 | Geier et al. | |
| 4,387,124 A | | 6/1983 | Pipkin | |
| 4,489,758 A | | 12/1984 | Malarz et al. | |
| 4,527,712 A | | 7/1985 | Cobbs, Jr. et al. | |
| 4,528,935 A | | 7/1985 | Patil et al. | |
| 4,585,148 A | | 4/1986 | Ito | |
| 4,586,837 A | * | 5/1986 | Johnson et al. | 400/216.2 |
| 4,590,857 A | | 5/1986 | Dahlgren | |
| 4,648,267 A | | 3/1987 | Seegmiller | |

(List continued on next page.)

OTHER PUBLICATIONS

NUR Advanced Technologies advertisement for Blueboard™ in *Digital Graphics Magazine,* May/Jun. 1997, p. 69.

Paasche AB (Fine Art) Airbrush instructions, reprinted courtesy of *Airbrush Digest,* 1983.

*Primary Examiner*—Richard Crispino
*Assistant Examiner*—Yewebdar Tadesse
(74) *Attorney, Agent, or Firm*—Morriss O'Bryant Compagni, PC

(57) ABSTRACT

A printing device for digital printing on a print medium is comprised of a wheel rotatable by a motor, a liquid dispenser for depositing a quantity of liquid on the wheel along the outer edge, and an air jet positioned adjacent the outer edge for removing the liquid from the outer edge and directing the liquid toward the print medium as the wheel rotates through the air jet. The outer edge includes a plurality of teeth transport the paint from the dispenser to the air jet. An electronically controlled motor is used to selectively rotate the wheel through the air jet thereby removing a desired amount of liquid from the wheel. The liquid is transported by the air jet toward the print medium. By employing a plurality of such printing devices, a full color digital image can be reproduced on any print medium.

52 Claims, 22 Drawing Sheets

U.S. PATENT DOCUMENTS

| | | | |
|---|---|---|---|
| 4,720,801 | A | 1/1988 | Boll |
| 4,723,712 | A | 2/1988 | Egli et al. |
| 4,731,621 | A | 3/1988 | Hayamizu et al. |
| 4,750,009 | A | 6/1988 | Yoshimura |
| 4,764,780 | A | 8/1988 | Yamamori et al. |
| 4,778,642 | A | 10/1988 | Lee et al. |
| 4,913,050 | A | 4/1990 | Beaver et al. |
| 4,957,782 | A | 9/1990 | Medler et al. |
| 5,017,407 | A | 5/1991 | Robertson |
| 5,076,767 | A | 12/1991 | Desaulniers et al. |
| 5,077,653 | A | 12/1991 | Barlet |
| 5,121,143 | A | 6/1992 | Hayamizu |
| 5,267,802 | A | 12/1993 | Parnell et al. |
| 5,389,148 | A | 2/1995 | Matsunaga |
| 5,511,695 | A | 4/1996 | Chia et al. |
| 5,598,973 | A | 2/1997 | Weston |

* cited by examiner 160
164
162
166
160
131
132
133
134
135

160

160
164
162

191
192
193
194
195
181
182
183
184
185
131
132
133
134
135
196
197

300
302
314

313
312
311
316
302
211
316
316
320
324
322

326
328

METHOD AND APPARATUS FOR DIGITAL PRINTING

CROSS-REFERENCE TO RELATED APPLICATIONS

This application is a continuation-in-part of and claims priority to U.S. patent application Ser. No. 10/155,884, filed on May 24, 2002, which is a continuation of U.S. patent application No. 08/878,650 filed on Jun. 19, 1997, now U.S. Pat. No. 5,972,111.

BACKGROUND

1. Field of the Invention

This invention relates generally to a method and apparatus for digital printing and, more specifically, to a method and apparatus that employs a metering device for metering a quantity of paint to be deposited on a surface to be painted and that deposits the metered quantity of paint on the surface.

2. Background of the Invention

Large format printing, such as the printing of billboard signs and building drapes, has generally followed printer technologies used in smaller scale printers, such as thermal and piezoelectric ink jet technologies. Such technologies, when employed for large scale printing, are relatively expensive, with large format thermal ink jet printers costing the range of about $250,000 to $350,000 and large format piezoelectric printers costing about $700,000 to $800,000.

Such ink jet printers work by depositing small droplets of ink in various colors, typically cyan, magenta, yellow and black, on a print medium to form a color image. Conventional thermal ink jet printing heads include a plurality of nozzles and thermal elements. Ink is expelled from the nozzles in a jet by bubble pressure created by heating the ink by the thermal elements while the nozzles and thermal elements are in close proximity. One such ink jet printing head, as described in U.S. Pat. No. 5,121,143 to Hayamizu, includes a thermal head member having at least one thermal element consisting of a plurality of thermal dot elements and a plurality of electrodes of different widths connected to each thermal element whereby different widths of heated portions of the thermal element are obtainable to vary the amount of ink jetted in one dot. Another such ink jet printing head is described in U.S. Pat. No. 4,731,621 to Hayamizu et al.

Another type of print head is disclosed in U.S. Pat. No. 4,764,780 to Yamamori et al. in which an ink ejection recording apparatus includes a plurality of ink ejection heads connected to an ink tank, each of the ink ejection heads having an ink nozzle through which minute ink droplets are discharged in accordance with an electric signal and an air nozzle opposing the ink nozzle and adapted for forming an air stream which accelerates the ink droplets toward a recording medium.

Typical desk top ink jet printers for home or office use are relatively inexpensive but are usually limited to printing on standard office size sheets of paper, such as 8½×11 or similar standard sizes. Some wide format printers, however, are able to accommodate 16 feet or wider substrates such as films, paper, vinyl, and the like and can print 300 $ft^2$ per hour, depending on the resolution of the print. Such machines sometimes employ piezoelectric printhead technology utilizing several printheads per color with numerous nozzles per printhead to deposit ink onto the print medium.

In addition to the cost of the machine itself, which employs relatively small orifices, valves and nozzles for depositing the desired quantity and color of ink on the print medium, very fine grade inks are required in which particle sizes of the pigments within the inks are kept to a minimum to help keep the orifices, valves, and nozzles of the ink system from becoming clogged. Such inks are expensive and thus result in billboard sized prints to be rather expensive. Despite the high quality and expense of ink products, clogging of the printhead is still a problem with current printer technologies.

Many large format printers also use water-based inks that may not be suitable for outdoor use. Accordingly, special waterproofing systems and techniques must be employed such as treating the printing medium with a substance that binds with the ink once deposited to form a waterproof mark or laminating the print with a weatherproof film. These weatherproofing techniques and processes add expense to the cost of each print.

There are some applications for digital printing where the resolution is not a significant issue. These applications include very large signage such as large billboard signs or building drapes as were used in the 2002 Salt Lake City Winter Olympics. Billboards, which are typically about 14 feet×48 feet do not require extremely sharp resolution as the viewing distances are typically more than 100 feet away. Another application in which lower resolution imaging may have significant usefulness is in stadium graphics such as printing on football field end zones (both grass and artificial turf), grass infields of race car tracks and foul territories and warning tracks of baseball fields. Military applications include applying camouflage painting schemes to ship hulls, decks and structures, as well as tanks and large decoys. Other applications may include the printing of imagery on freeway embankments, roadways, and roof tops. Still other applications may include printing on carpet and other textiles. To obtain sufficient image coverage, large quantities of pigmented paint or sublimating dye are very desirable to produce a highly visible image. In situations where the media is a building drape, a rocky embankment, plush carpeting, or a grass field, such large quantities of paint are necessary to fill voids in media so that the desired image is visible. The volumes of paint needed to produce such images are much greater than ink jet technology could ever reasonably deliver. As such, current methods of painting football end zones include hand painting with rollers and other conventional paint application devices to produce a desired image. Such methods are extremely time consuming and require significant manpower to accomplish.

In the case of building drapes, such as those used in the 2002 Winter Olympics in Salt Lake City, the fabric was a screen-type material that would allow air to easily pass through the fabric. Because of the difficulty in applying paint to such materials using current state of the art techniques, the building drapes were not only of quite low resolution, but were generally washed out in both vibrancy and color.

Thus, it would be advantageous to provide a method and apparatus for producing images on virtually any medium including highly porous media or media having significant voids where large quantities of paint are necessary to produce a desired image. Furthermore, it would be highly advantageous to provide a method and apparatus for digital printing that is compatible with any paint including fast drying paints such as all surface acrylic enamels. It would be a further advantage to provide a method and apparatus for digital printing that is compatible with extremely inexpensive paints, such as common house paints. Digital printing with sign type ink jet inks can run up to $0.50 per square foot. Typical ink prices run $0.20 per square foot. Cheap house paint can result in digital imaging paints costing between 2 and 3 cents per square foot. Such capability is very significant in large signage applications which are now near commodity based pricing.

SUMMARY OF THE INVENTION

Accordingly, a paint injector is provided comprising at least one air nozzle that directs a jet of air across a moving member, the member having ink, paint, or other similarly pigmented liquid material disposed thereon. The air jet blows or pulls the paint off of the member and onto a print medium, such as paper, vinyl, film, grass, dirt, rock, asphalt, carpet, fabric or other textiles, or other print media known in the art. The moving member is comprised of a wheel having paint disposed on the outer rim or edge thereof.

In one embodiment, a relatively small saw-type blade or gear may be used as a miniature gear pump to meter paint for digital printing. The edge or teeth of the gear or blade grab paint within the gap between each tooth from a paint reservoir. The blade is advanced between a pair of air jets and the paint in the gap is blown off from both sides of the blade. As the blade continues to rotate it interlocks with a second blade having substantially the same teeth spacing and configuration. The engagement of the teeth between the first and second blades causes any paint remaining between each tooth of the first blade to be forced out by the interlocking nature of the blades. As the paint is removed from the teeth of the first blade, small scrapers are used to remove dried paint from the edges and surface of the blades.

The paint reservoir is comprised of a block having a slit therein for receiving a portion of the blade in one side thereof, the slit is in fluid communication with an internal reservoir containing paint. As the blade rotates through the slit, paint contained in the reservoir is received and maintained between the teeth of the blade as the portion of the blade containing paint is rotated out of the block. As the blade continues to rotate, the teeth containing paint pass through one or more air jets directed at the teeth which remove the paint from between the teeth and transport the paint onto a print medium.

In another embodiment, a toothless wheel is provided in which paint is applied to the outer edge or rim of the wheel. The paint may be applied by a roller or other metering device. As the paint coated portion of the wheel passes through one or more air jets, the paint is blown from the edge of the wheel and onto the print medium.

While the air jets can be configured to remove nearly all of the paint from the blade, wheel or gear, for some quick drying paints or materials, there may be a need to provide a means of removing paint from the side surfaces of the blade, wheel or gear. As such, various scrapers may be positioned proximate or in contact with the surface of the blade to be cleaned so that upon rotation of the blade, the scraper can remove any paint deposited thereon. Such paint removal keeps the blade, wheel or gear, as the case may be, in a clean condition to ensure that the amount of paint being metered by the blade, wheel or gear is relatively precisely controlled.

Digital painting in each color occurs by using a computer to selectively control the advancing a paint coated blade or wheel through an air stream to remove the paint and project it onto a surface. The air stream remains relatively constant. Paint modulation for digital printing is achieved by the controlled advancement of the wheel through the air stream. By including multiple blades or wheels associated with multiple paint colors and controlling the position of each blade or wheel relative to the medium, digital painting can be accomplished to reproduce a preselected digital image onto a selected medium.

The present invention may be employed to apply paint to various medium regardless of the porosity of such medium. For example, grass fields, carpets and building drapes can be digitally painted with the printing device and techniques of the present invention.

It is also contemplated that the present invention may be employed to deposit other liquid, liquid-based or bondable materials onto or toward a surface in a relatively precise and controlled manner. That is, there is often a need to apply oils, finish materials, such as acrylics or polyurethanes to a surface in a controlled manner to produce a desired result, such as film thickness. Additionally, the present invention may be employed to apply such materials as etchants for glass applications as well as materials that may be employed in various masking operations, such as photo resists. The present invention, while being described with reference to "digital printing" by way of example may employ such instruments and techniques to other applications in various other fields of art.

BRIEF DESCRIPTION OF THE DRAWINGS

FIGS. 11A, 11B and 1C are top, front and side views, respectively, of a further assembled print head of the print head shown in FIGS. 6A, 7A, 8A, 9A and 10A;

DETAILED DESCRIPTION

Figure 1:
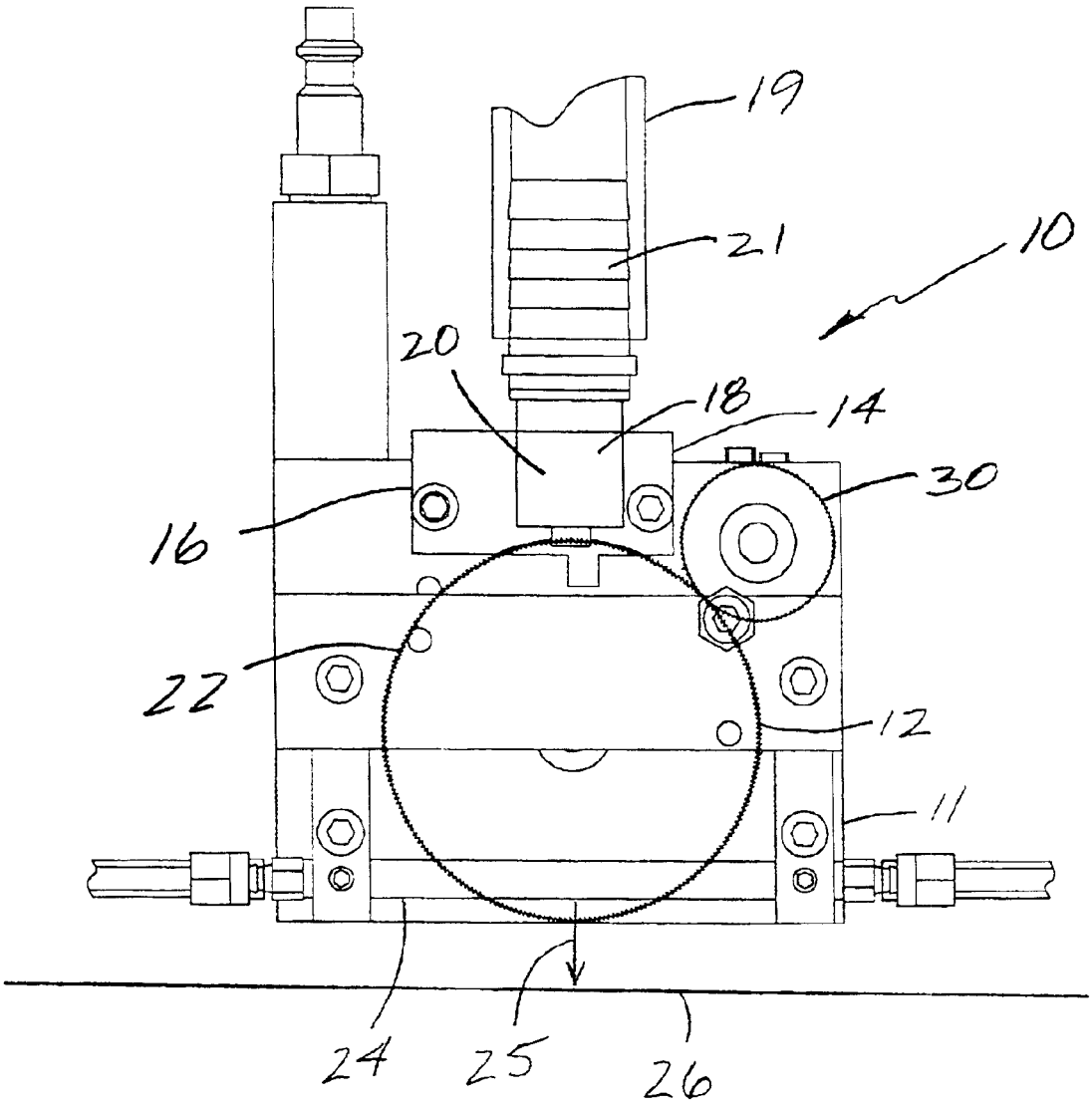
FIG. 1 is a front view of a first embodiment of a paint injector in accordance with the present invention.

Referring to FIG. 1, a printing device, generally indicated at 10, in accordance with the present invention is illustrated. The printing device 10 is comprised of a rotatable wheel 12 mounted relative to a frame assembly 11. The use of the term "wheel" herein is intended to encompass any such like structure including one or more disks, blades and spoke-like structures that have an outer edge that can carry a liquid in accordance with the principles of the present invention. The wheel 10 is in fluid communication with a liquid dispenser 14 having a base member 16 and a liquid reservoir 18. The wheel 10 is partially inserted into the base member 16 and in fluid communication therewith for receiving a liquid, such as one of paint, ink, die, etchant, solvent, oil, acrylic, and polyurethane. While such materials can be applied utilizing the printing device 10 of the present invention, the remainder of the discussion will focus upon the use of the printing device 10 to apply paint, knowing that a simple substitution of materials may be employed to apply such other materials.

The liquid dispenser 14 also includes a liquid source 19, in this example, a tube containing paint 20 coupled to a fitting 21 that is in turn coupled to the base member 16. The paint 20 contained in the reservoir 18 is applied to the outer edge 22 of the wheel 12 as the outer edge 22 passes through the base member 16. As the wheel rotates in a counter-clockwise direction, the paint coated portion of the wheel 12 rotates between a pair of air jets 25 emanating from a pair of pressurized tubes, only one tube 24 of which is visible. The air jet removes the paint 20 from the outer edge 22 and blows the paint toward a print medium 26.

Figure 1C:
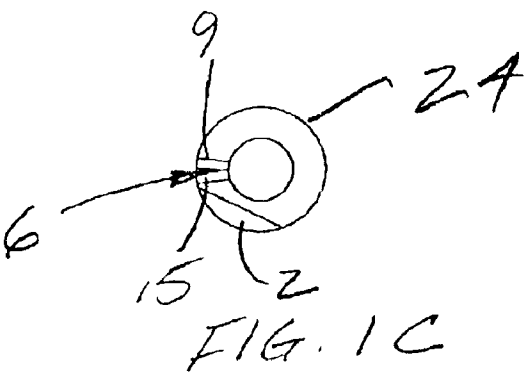
FIGS. 1A, 1B and 1C are side, partial side and cross-sectional views, respectively, of an air manifold in accordance with the principles of the present invention.
Figure 1B:
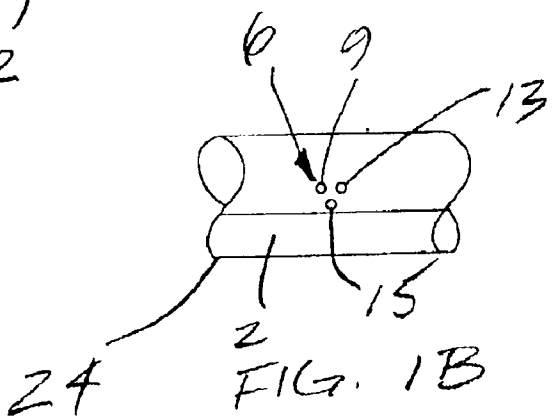
Figure 1A:
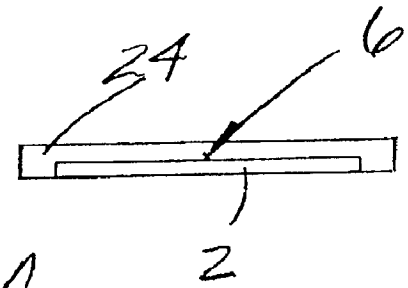

As further shown in FIGS. 1A–1C, the tube 24 is provided with a flat portion 2 so as to allow clearance for the wheel 12. Proximate the flat portion 2 is orifice set 6. The orifice set 6 shown in FIG. 1B, comprises three orifices 9, 13 and 15. The orifices extend through the side wall of the tube 24 so that pressurized air within the tube 24 creates air jets emanating from the orifices 9, 12 and 15. Each set of orifices is configured to remove paint from one side of a particularly associated wheel containing paint thereon. In addition, multiple orifices in each orifice set is configured to not only remove the paint from the wheel, but to focus the paint toward a single point on the print medium. Thus, the orifice 15, for example may be directed at the wheel to remove paint in a purely radial direction, while the orifices 6 and 13 are angled above the air jet created by orifice 15 to help eliminate conical divergence of the paint as it is pulled from the surfaces of the wheel. For a print head assembly comprising a plurality of printing devices, as will be described herein, a longer tube with a plurality of orifice sets will be provided, with one orifice set provided for each wheel of the print head.

A freely rotatable cleaning wheel 30 is secured proximate the wheel 12 and engages the outer surface thereof. In the case where the wheel 12 is provided with a plurality of teeth along the outer edge 22, the cleaning wheel 30 is also provided with a plurality of teeth along its outer edges having a size and pitch to substantially match the size and pitch of the teeth of the wheel 12. As the wheel 12 rotates, the cleaning wheel 30 is caused to rotate therewith in a gear mating arrangement. This meshing of teeth of the two wheels 12 and 30 causes any residual paint contained in interstices between adjacent teeth to be forced out prior to reentry of the teeth into the reservoir 18. As such, the quantity of paint contained in the teeth of the wheel 12 during each revolution remains relatively constant without the possibility of dried paint clogging the gaps between teeth.

Figure 1D:
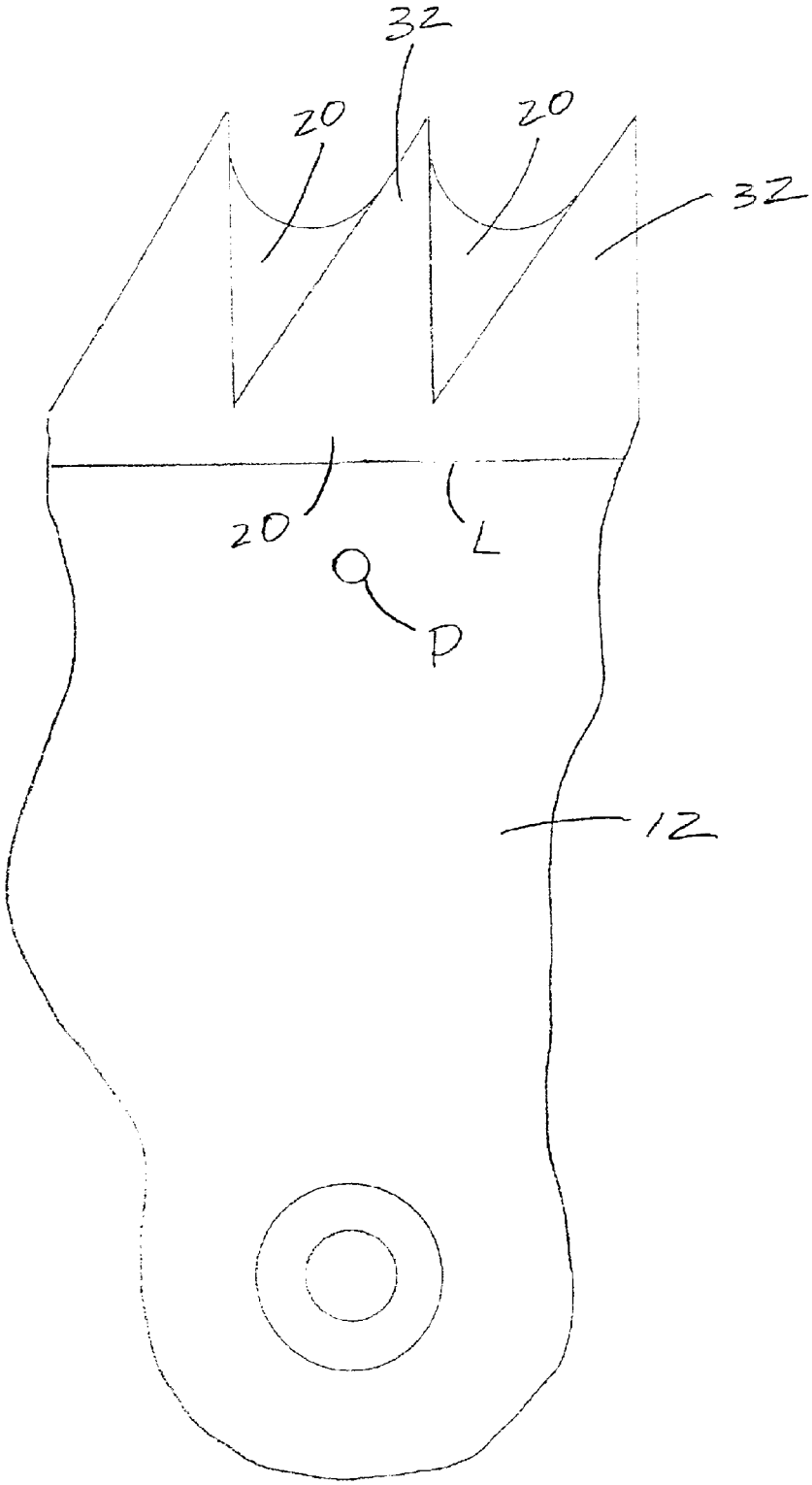
FIG. 1D is a partial, close-up side view of a bladed wheel in accordance with the principles of the present invention.

As shown in FIG. 1D, which shows a partial close-up view (not to scale) of the wheel 12, the paint 20 is held in the interstices or gaps between adjacent teeth 32 by surface tension in the paint. Moreover, the paint 20 covers a portion of the side surface of the wheel 12 above the teeth 32 as well as the side surfaces of the teeth 32. Thus, in order to remove substantially all of the paint 20 from the wheel, the air jet is directed at a point P above the line L representing the edge of the paint 20 on the wheel 12. As the paint 20 is pulled from the side surfaces of the wheel 12 by the air jet, the paint in the gaps between teeth 32 is also pulled therefrom such that the wheel is substantially cleaned as it passes the air jet. Moreover, flow of air over the edges formed by the teeth 32 causes any paint 20 to be pulled from all surfaces of the wheel 12, even those surfaces at the bottom of the teeth 32. Sharp edges of the teeth 32 also facilitate atomization and release of paint from the wheel 12.

The wheel 12 and the cleaning wheel 30 may be formed from two slitting saw blades, with the wheel 12 used as a miniature gear pump to meter paint for digital printing. The edge of the wheel 12 grabs paint within the gap of each tooth from the paint reservoir 18. The wheel 12 is advanced in front of an air jet and the paint in the gap is blown off from both sides. As the wheel 12 continues to rotate, it interlocks with the cleaning wheel 30. Any paint remaining between each tooth is forced out by the interlocking nature of the blades. Small scrapers may also be used to remove dried paint from the edges and/or side surfaces of the wheels 12 and 30.

Air being blown from the tubes through their respective nozzle orifice disperses or pulls paint from the wheel 12 to the print medium 26. Depending on the viscosity of the paint, the width of the wheel 12 and the radial width of the paint proximate the outer edge of the wheel, a relatively precise amount of paint can be effectively metered by advancing the motor and thus rotating the wheel 12 a relatively precise fraction of a rotation. Such an apparatus may produce images having a resolution of approximately 10 dpi or better, which is more than adequate for large signs such as billboards, grass painting and the like.

While an air stream has been described as the preferred vehicle for transporting the paint from the wheel to a print medium, it is also contemplated that other fluid streams, such as thinner, steam, or other materials known in the art, may be employed or mixed with air or another gas to transport the paint from the wheel 12 to a print medium.

Figure 2:
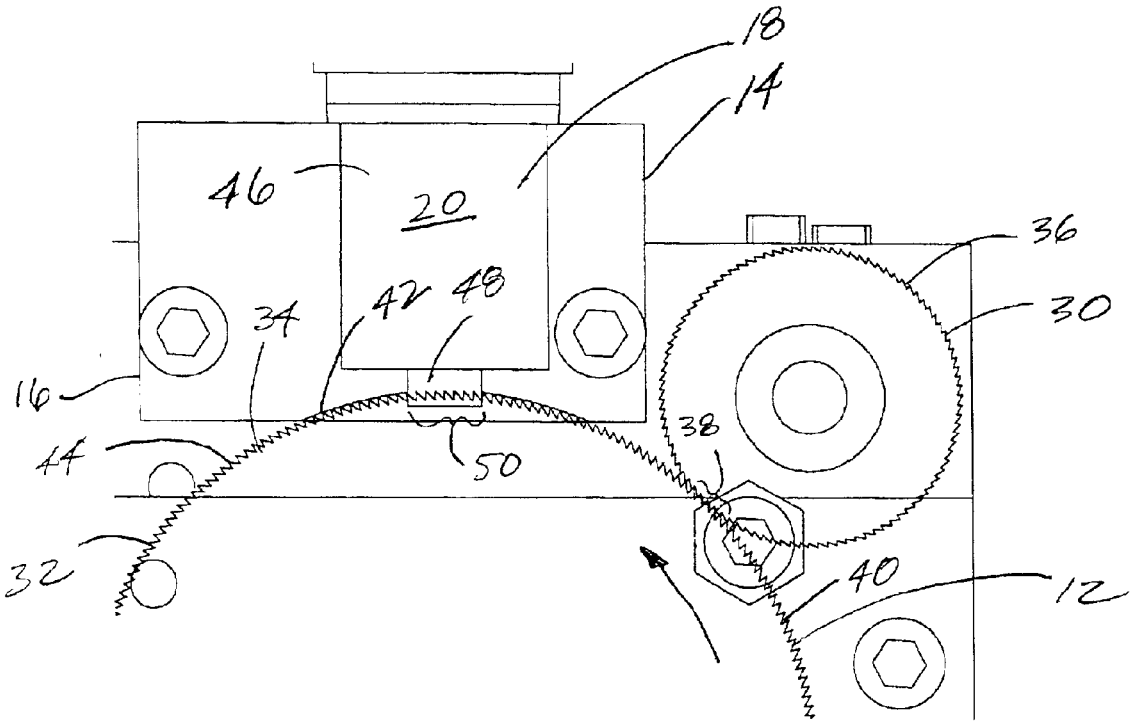
FIG. 2 is a partial side cross-sectional view of the printing device of FIG. 1.
Figure 2A:
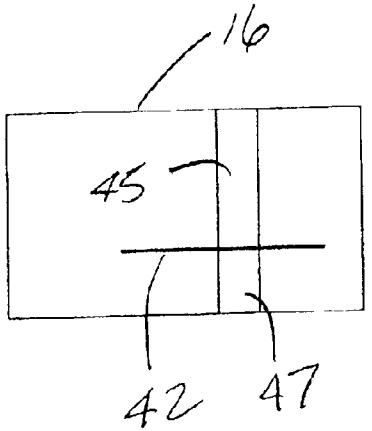
FIGS. 2A, 2B, 2C and 2D are bottom, end, top and side cross-sectional side views, respectively of a paint reservoir in accordance with the principles of the present invention.
Figure 2B:
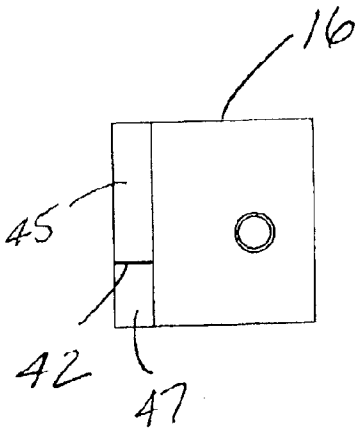
Figure 2C:
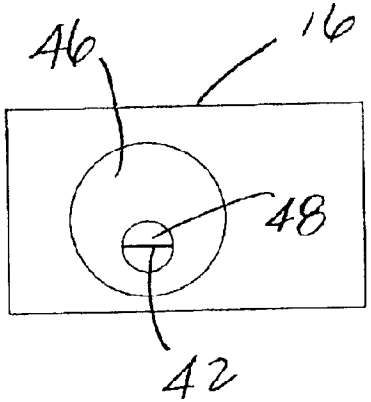
Figure 2D:
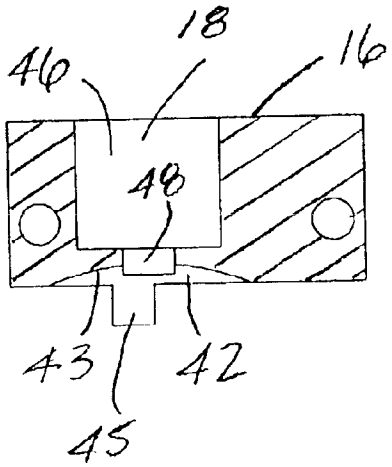

As shown in FIG. 2, the plurality of teeth 32 along the outer edge 34 of the wheel 12 mesh with the plurality of teeth 36 disposed around the cleaning wheel 30. The size and spacing or pitch of the teeth 32 are substantially the same as the teeth 36 on the cleaning wheel to allow engagement of the teeth 32 and 36 in a gear-like manner. Moreover, depending upon the diameter of the wheel 12 and the diameter of the cleaning wheel 30, the several teeth 32 and 36 on each wheel 12 and 30, respectively, can simultaneously mesh together to provide a range of engagement 38. As the wheel 12 rotates as in a counter-clockwise direction as indicated by the arrow and teeth 32 and 36 mesh together, the teeth 36 of the cleaning wheel force out any paint residue that may be contained within the interstices 40 between adjacent teeth 32 of the wheel 12. This occurs after the outer edge 34 has passed through the air jets (not shown) but before the outer edge 34 has entered the paint dispenser 14.

As further shown in FIGS. 2A–2D, as the outer edge 34 and thus the teeth 32 of the wheel 12 enter the reservoir 14, they enter into a slot or channel 42 formed in the base member 16 of the dispenser 14. The base member 16 is formed from a single block of material, such as aluminum. The slot 42 has a bottom curved surface 43 that matches the radius defined by the outer tips 44 of the teeth 32. Indeed, the slot 42 may be formed by inserting the wheel into the block 16 as it rotates, thus cutting its own slot to provide relatively tight tolerances between the surfaces of the slot, both side walls and bottom, and the surfaces of the wheel 12 that enter the slot 42.

The reservoir 18 of the dispenser 14 is comprised of a primary chamber 46 which feeds a secondary chamber 48. The secondary chamber 48 is in fluid communication with the slot 42 and exposes a section of teeth 50 therein into which paint 20 contained in the reservoir 18 can flow. As the section of teeth 50 rotate out of the secondary chamber 48, the contact between the surfaces of the wheel 12 and the surfaces of the slot 42 cause paint not contained within the interstices 40 between teeth 32 to remain with the secondary chamber 48. In addition, a raised sections 45 and 47 proximate the opening into the secondary chamber 48 extending toward the wheel 12 are provided about the slot 42 to further scrape paint from the sides of the wheel 12 as the wheel rotates relative thereto to clean the side surfaces of the wheel 12. The raised portions 45 and 47 are positioned on the entry side of the slot 42, that is the side of the slot 42 that the wheel 12 first enters as it rotates. Such scraping maintains the amount of paint applied to the wheel 12 on each rotation so that the amount of paint applied to the wheel 12 along the outer edge 44 is substantially metered. Also, depending upon the fit between the wheel 12 and the slot 42, more or less paint 20 can be allowed to be applied to the outer edge 44 and the side surfaces of the wheel 12 proximate the outer edge 44. Thus, in situations where initiated paints, such as thermal-setting paints or UV curable paints that require exposure to dry, more paint can be deposited for the same amount of wheel 12 rotation, the gap between the wheel 12 and the slot 42 can be widened by either providing a block 16 with a wider slot 42, utilizing a thinner wheel 12, or utilizing a wheel with a slightly smaller outer diameter.

Figure 3:
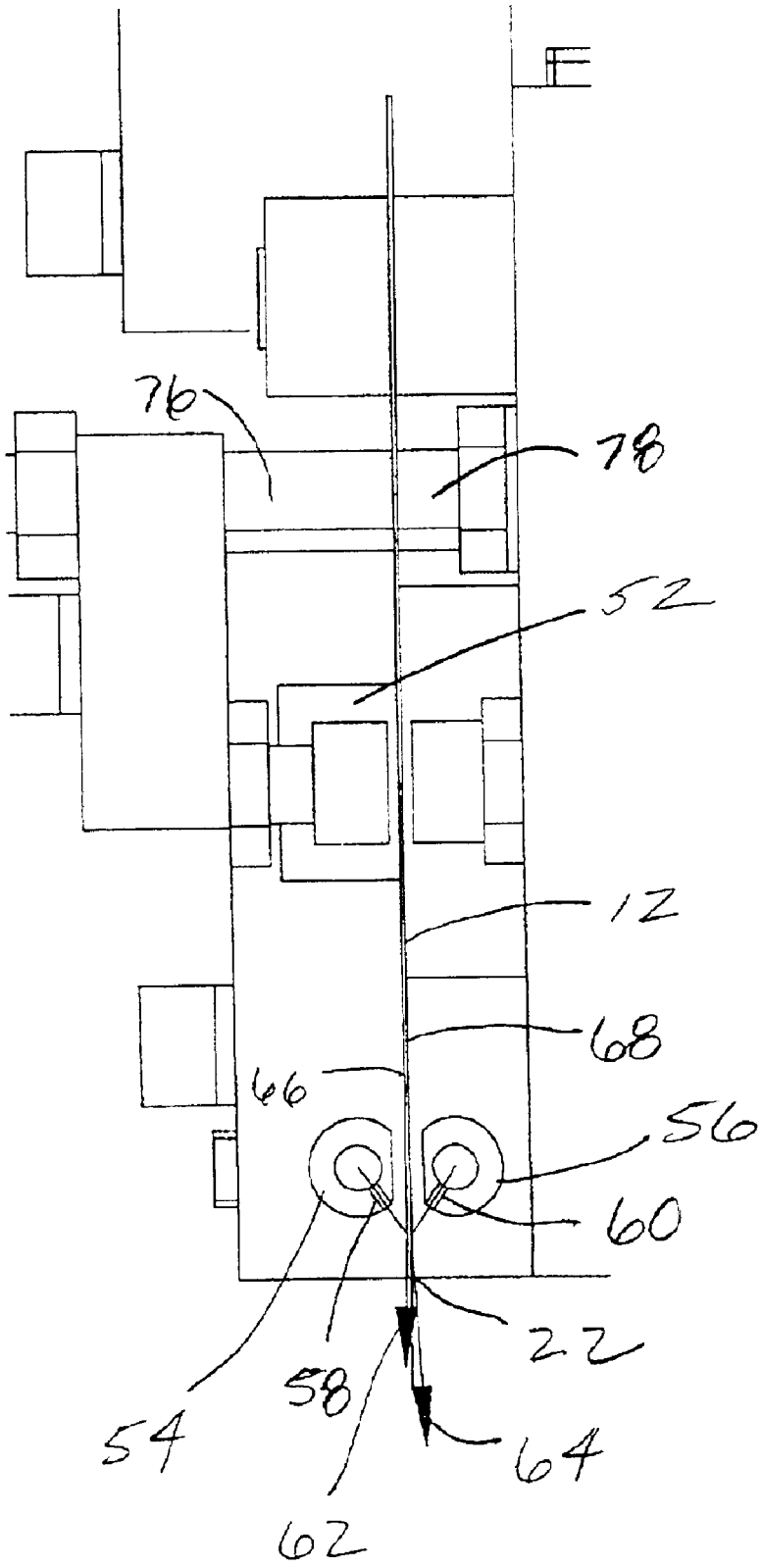
FIG. 3 is a partial end view of the printing device shown in FIG. 1.
Figure 4:
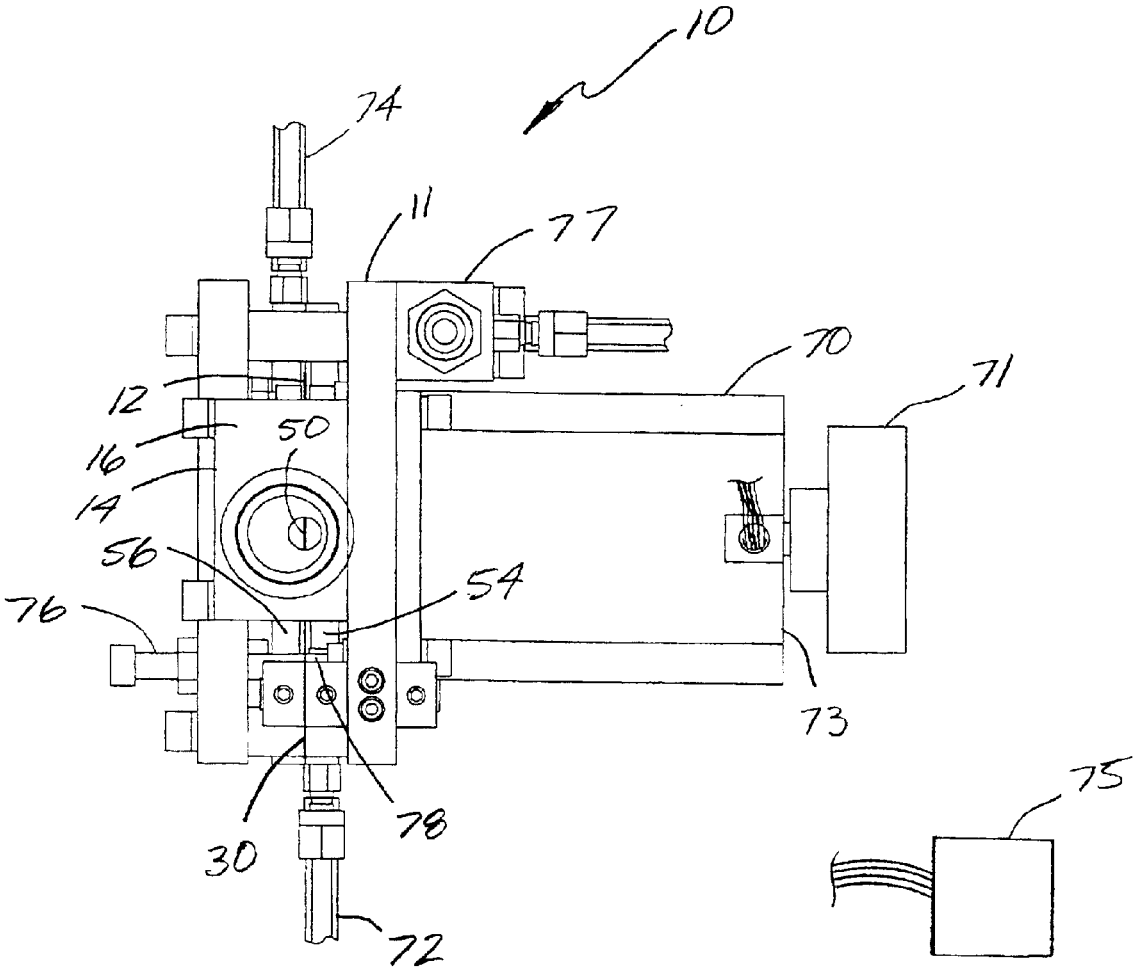
FIG. 4 is a top view of the printing device shown in FIG. 1.

As further illustrated in FIG. 3, the wheel 12 is attached to the shaft of a motor (not visible) with a hub 52 concentrically attached to the center of the wheel 12. The wheel 12 passes between a pair of tubes 54 and 56 that are positioned adjacent to the outer edge 22 of the wheel 12 each include at least one transversely extending bore 58 and 60, respectively, through a side wall thereof that are angled inwardly toward the wheel 12 and outwardly toward the outer edge 22. The bores 58 and 60 form nozzle orifices for producing air jets when the inside of the tube is pressurized. As the tubes 54 and 56 are pressurized with air (or other gaseous or liquid substance) to form air jets 62 and 64, respectively. The tubes 54 and 56 are coupled to an a manifold assembly 77 (as shown in FIG. 4) that provides air to and between air each printing device 10. The air jets 62 and 64 are oriented to contact the side surfaces 66 and 68, respectively, of the wheel 12 at a point away from the outer edge 22 of the wheel 12. This provides a flow of air over a portion of the side surfaces 66 and 68 proximate the outer edge 22 to remove paint not only being carried on the outer edge 22 of the wheel 12, but also being carried on the side surfaces 66 and 68. As the air jets 62 and 64 travel over the side surfaces 66 and 68 and past the outer edge 22 of the wheel 12, paint is pulled from the surfaces 66 and 68 and the outer edge and carried in the air jets 62 and 64 toward a desired print medium (not shown).

Figure 5:
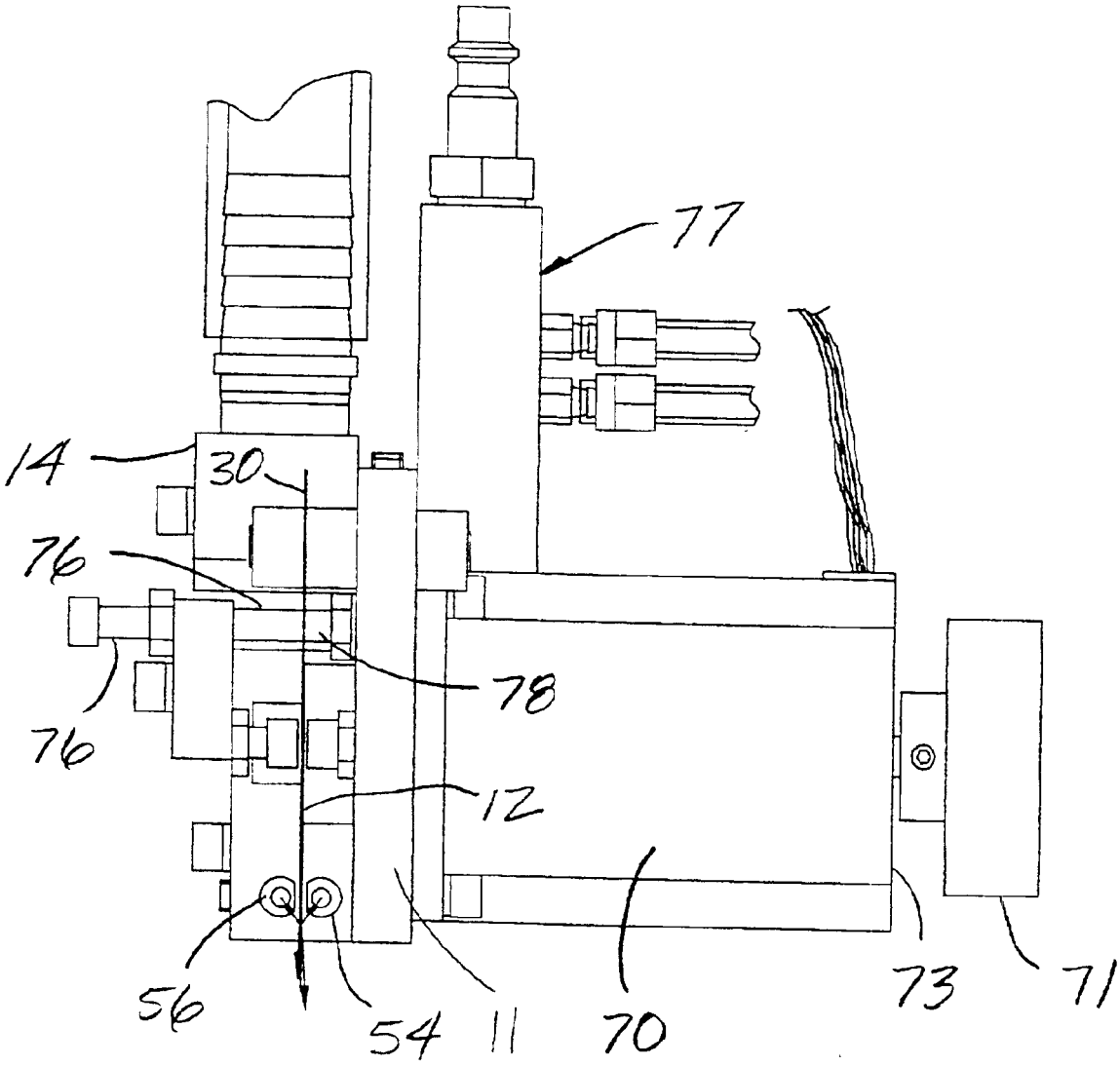
FIG. 5 is an end view of the printing device shown in FIG. 1.

Referring now to FIGS. 4 and 5, a motor 70 is secured to the frame member 11 to rotate the wheel 12. The motor is comprised of a 2-phase high torque stepper motor. For example, the stepper motor may be a HT23-400-D stepper motor from Applied Motion. The HT23-440-D motor is a Nema 23 style motor, high torque, double shaft motor with 8 leads, 1.8 degree step angle, 187 oz-in, a motor length of 2.99", 2 Amps, and 4.5 Volts. Alternatively, a micro-stepping drive could be coupled to the 2-phase stepper motor to further resolve the 1.8 degree step angle into smaller steps.

A motor damper 71, such as an Oriental Motor D6CL-6.3 damper, is attached to the distal end 73 of the motor 70. Such a damper is provided with a 0.25" shaft size is 3.46 oz. and has a 1.01 oz.-in×in. rotational inertia. The damper 71 allows for higher speed printing. That is, the printing process in accordance with the present invention provides that the paint from the printing device is quickly started and stopped depending upon the desired color to be deposited. Thus, because the print head passes over the media surface at a uniform speed, each color motor is required to quickly accelerate and decelerate through a variety of speeds. This can result in torsional resonances in the motor and motor stalling. The damper 71 eliminates most of these problems by preventing resonance within the motor 70. Alternatively, while typically being more expensive, a 5-phase motor could be used to bypass the torsional resonance problems. Alternatively, a servo motor could be used to bypass the resonance problems.

The motor 70 is electronically coupled to a computer 75 that controls rotational operation of the motor, both in number of rotational steps and timing. Separate control of each individual paint motor 70 allows for digital printing in multiple colors, with each printing device 10 printing a particular color. The computer 75 is provided with software to control not only rotation of the motor 70, but also position of the printing device 10 relative to a print medium (not shown). Thus, once input into the computer 75, a digital image can be reproduced by the printing device 10, and as will be described in more detail, herein, by utilizing multiple printing device 10 together, a full color digital image can be reproduced on virtually any print medium.

The rotation of the shaft of the motor 70 with the controller or computer 75 is accomplished by converting digital signals from the computer into alternating phase currents for causing one or more rotational steps of the motor 70. Such signals are discrete signals to instruct selective rotation of the shaft of the motor 70. In the case where the motor 70 is a stepper motor, the signals are sent in the form of electrical pulses, each pulse designating a single step or micro-step that the shaft of the stepper motor 70 is to rotate. A typical stepper motor provides 200 steps per revolution with each step being activated by a current in the range of several amperes, depending on the current requirement of the motor. Thus, if it is desired to deposit the quantity of paint deposited on the wheel 12 in one half of a revolution of the wheel 70, 100 pulses would be sent by the computer 75 with each pulse converted by circuitry into alternating phase currents depending on the current requirements of the stepper motor 70 sufficient to cause the stepper motor 70 to rotate its shaft one step, and the shaft would rotate 100 steps.

One way of driving the motor 70 is to perform all shaft advances for the printing device by time calculations made thereby eliminating the need of a calculating device within the printing device itself. Thus, all wheel 70 advances for the same color of paint, in addition to spatial motions of the printing devices relative to a print medium for depositing a metered paint at relatively precise locations, can be made by the computer 75.

If a DC servo motor is employed, the signal sent from the computer 75 would be converted into a voltage by the circuitry necessary to rotate the shaft of the DC motor a desired portion of a rotation. A feedback device, such as an optical encoder, would be employed to control the precise rotation of the shaft of the motor 70. It is also contemplated that a crude metering of paint could be accomplished by simply providing a timed duration of power to a direct current, induction, air, or other similar motor without feedback.

A pair of air feed tubes 72 and 74 supply pressurized air to the tubes 54 and 56. This pressurized air is used to blow the paint from the wheel 12 at the desired location and in the desired quantity on a print medium. The paint dispenser 14 sits atop the wheel 12 and is aligned such that a portion 50 of the wheel 12 extends into the base 16 of the dispenser 14 for receiving paint therefrom.

If paint accumulates on the wheel 12, various scrapers, in the form of threaded fasteners 76 and 78, are positioned to having their distal ends in contact with or close to both side surfaces of the wheel 12. By placing the scrapers 76 and 78 at the point of contact or near the point of contact between the wheel 12 and the cleaning wheel 30, the scrapers 76 and 78 not only keep paint from accumulating on the side surfaces of the wheel 12, but keep the wheel 12 and the cleaning wheel 30 in lateral alignment relative to each other.

Figures 6A, 6B, 6C:
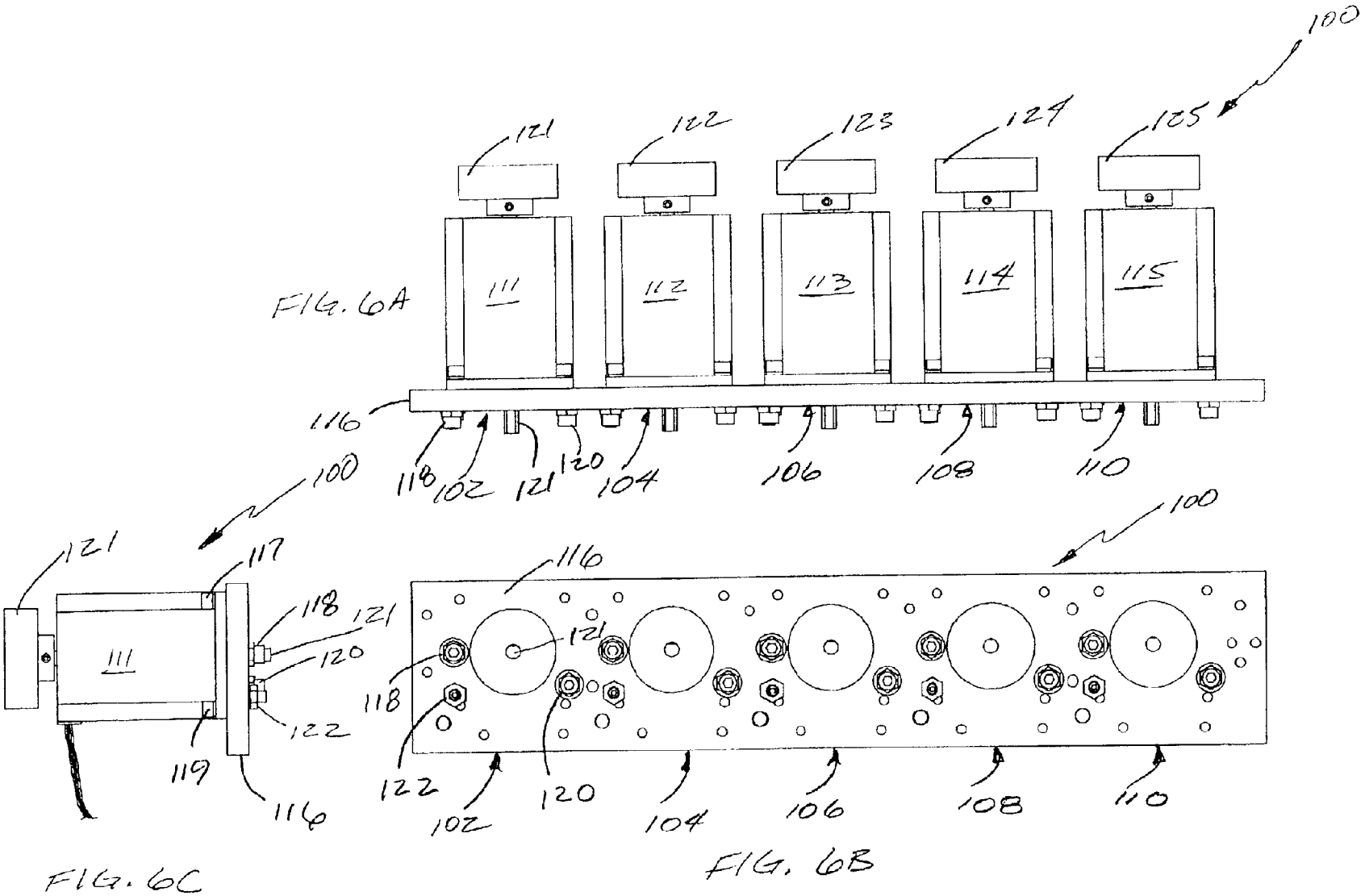
FIGS. 6A, 6B, and 6C are top, front and side views, respectively, of a first embodiment of a partially assembled print head in accordance with the principles of the present invention.

Referring now to FIGS. 6A, 6B and 6C, in order to achieve digital printing in multiple colors, a print head assembly, generally indicated at 100, is comprised of a plurality of individual printing devices in accordance with the present invention. While a four color print head may be sufficient for printing on white print media, a five color print head 100 as illustrated includes white as a color to allow printing on non-white surfaces, such as green grass. The print head 100 is provided with five printing devices 102, 104, 106, 108 and 110. The five printing devices 102, 104, 106, 108 and 110 are provided with one of yellow, magenta, cyan, black and white. With these five colors, the print head 100 can produce virtually any color in the color spectrum.

In order to better describe the components of the print head 100, the following drawings show the print head in various stages of assembly. As shown in FIGS. 6A–6C, the print head 100 is first assembled by attaching five motors 111–115 to a frame member 116, in this example an elongate plate having various holes and apertures formed therein for attaching and allowing access to the various components of the print head 100. Each motor 111–115 is provided with its own dampener 121–125 as previously described. The motors 111–115 are attached to the frame member 116 with a plurality of bolts 117 and 119 such that the motor is positioned on the back side of the frame member 116 with the shaft 121 of each motor extending through the frame member 116 to the front side thereof. Various scrapers 118, 120 and 122 may also be attached to the frame member 116. Two bolt heads and a set screw are locked in place to form scraping and alignment functions for each wheel or blade. These screws are placed at various radiuses from the motor shaft 121 to cause the dried paint to be plowed away from the air jet structure. Dried paint is disposed of as it falls out of the mechanism and on the floor or into a tray (not shown). The height of the bolt heads and set screw are adjusted to just make contact with the wheel or blade. As dried paint builds on the blade it is scraped away as the blade rotates and the paint makes contact with the fixed screw heads and set screw.

While the presently described print head 100 shows use of a different motor with each printing device, it is also contemplated that a single motor could be used for more than one printing device. For example, a transmission-type gear system could be employed to switch the motor between printing devices so that the motor drives the desired printing device as needed. Such a system, however, would likely be more complicated than the present embodiment which utilizes direct drive with a single motor for each printing device.

Figure 7A:
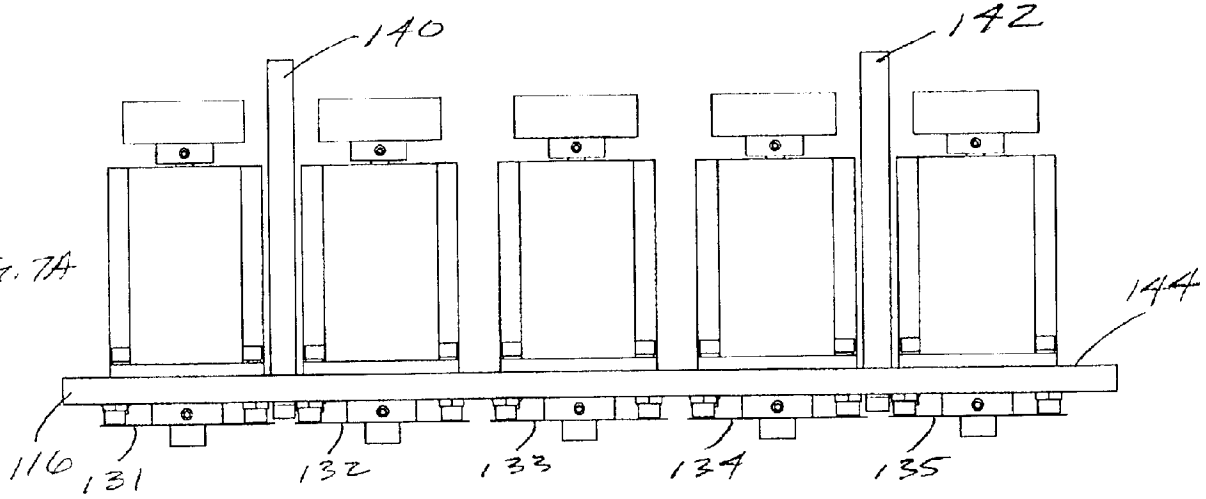
FIGS. 7A, 7B and 7C are top, front and side views, respectively, of a further assembled print head of the print head shown in FIG. 6A.
Figure 7B:
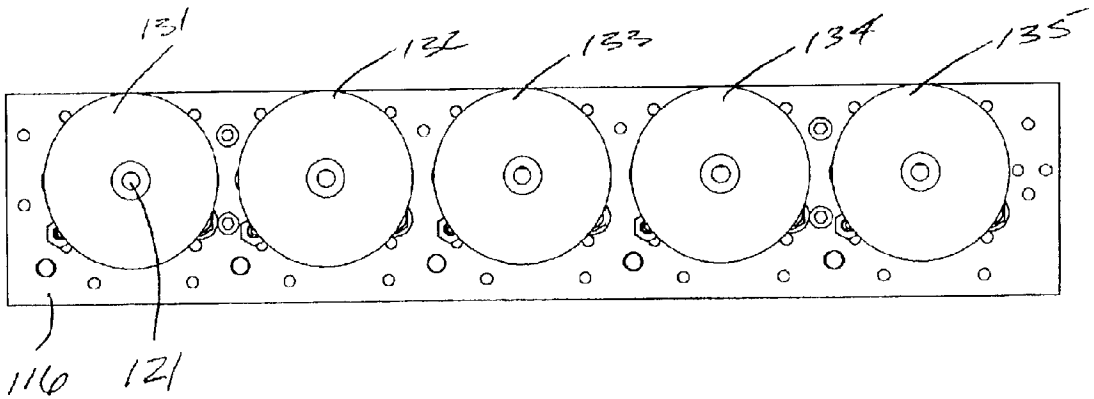
Figure 7C:
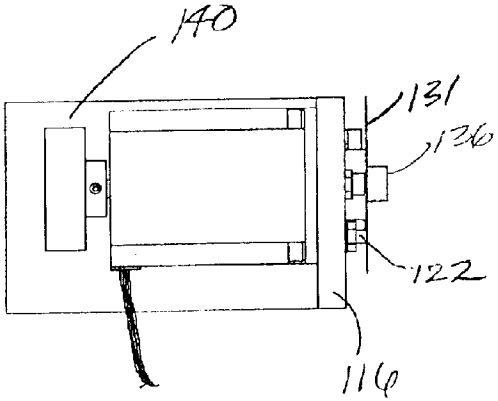

As further shown in FIGS. 7A, 7B, and 7C, the next step in the assembly process is to attached a wheel or blade 131–135 to each motor shaft. Each wheel 131–135 is mounted to a hub 136 that allows each wheel 131–135 to be mounted to its respective motor shaft. The hub may be attached to the wheel with metal bonding epoxy or other suitable attachment means such as welding or mechanical attachments known in the art. As shown in FIG. 7C, the wheel 131 is placed on the shaft 121 so that the back side of the wheel just contacts the scraping device 122. Thus, the hub 136 is attached to the shaft 121 at a point where the blade 131 is flush and in contact with the screw heads and set screw 122 discussed herein. This is repeated for each of the other wheels 132–135. A commonly available blade that works well with the present invention is blade part number 03296100 available from MSC Industrial Supply Co. and described as a high speed steel jewelers saw with a 2.5" outer diameter, a ½ inch hole, a thickness of 0.010 inch and 240 teeth disposed around its outer edge.

Figure 8B:
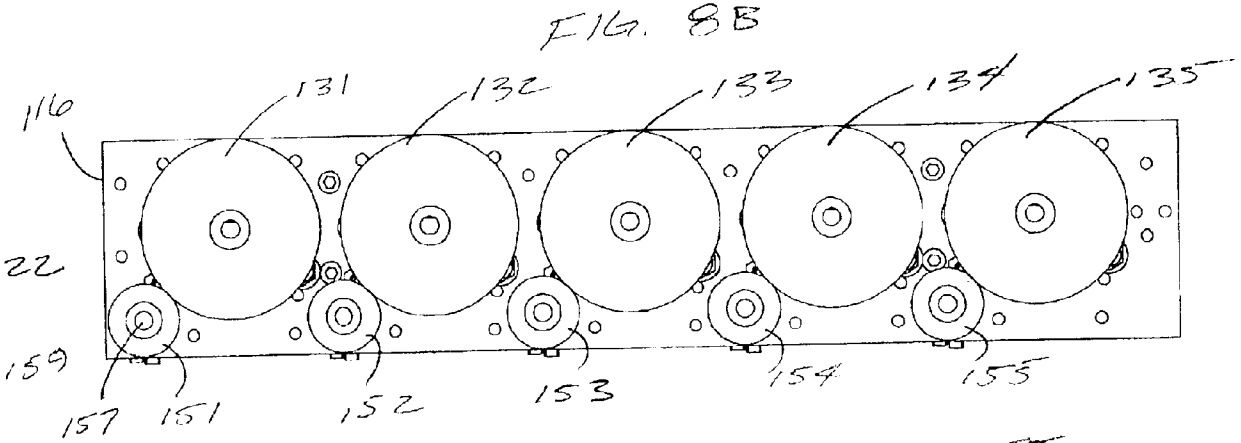
FIGS. 8A, 8B and 8C are top, front and side views, respectively, of a further assembled print head of the print head shown in FIGS. 6A and 7A.
Figure 8A:
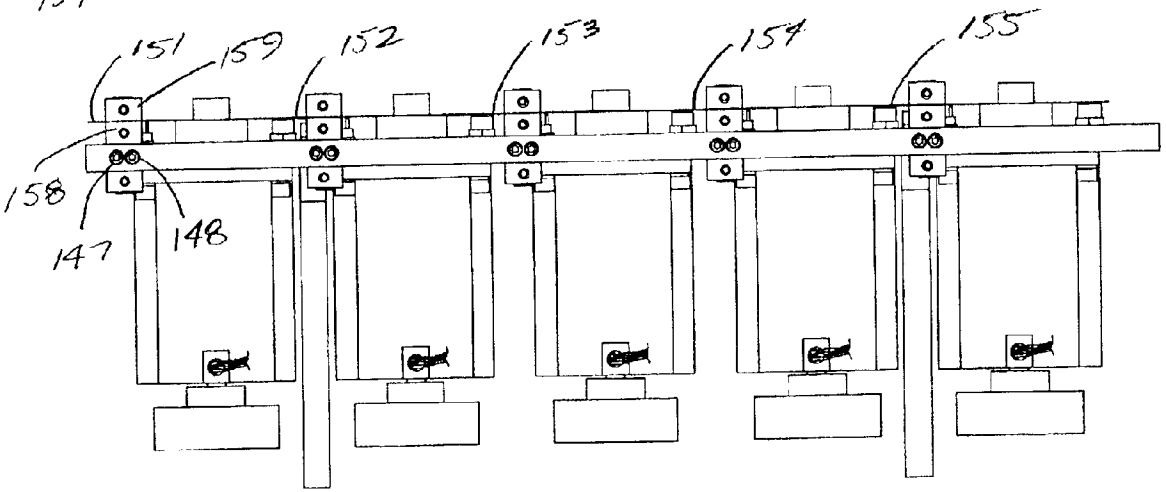
Figure 8C:
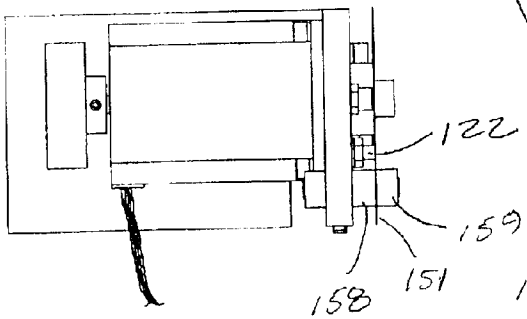
Figures 9A, 9B, 9C, 9D:
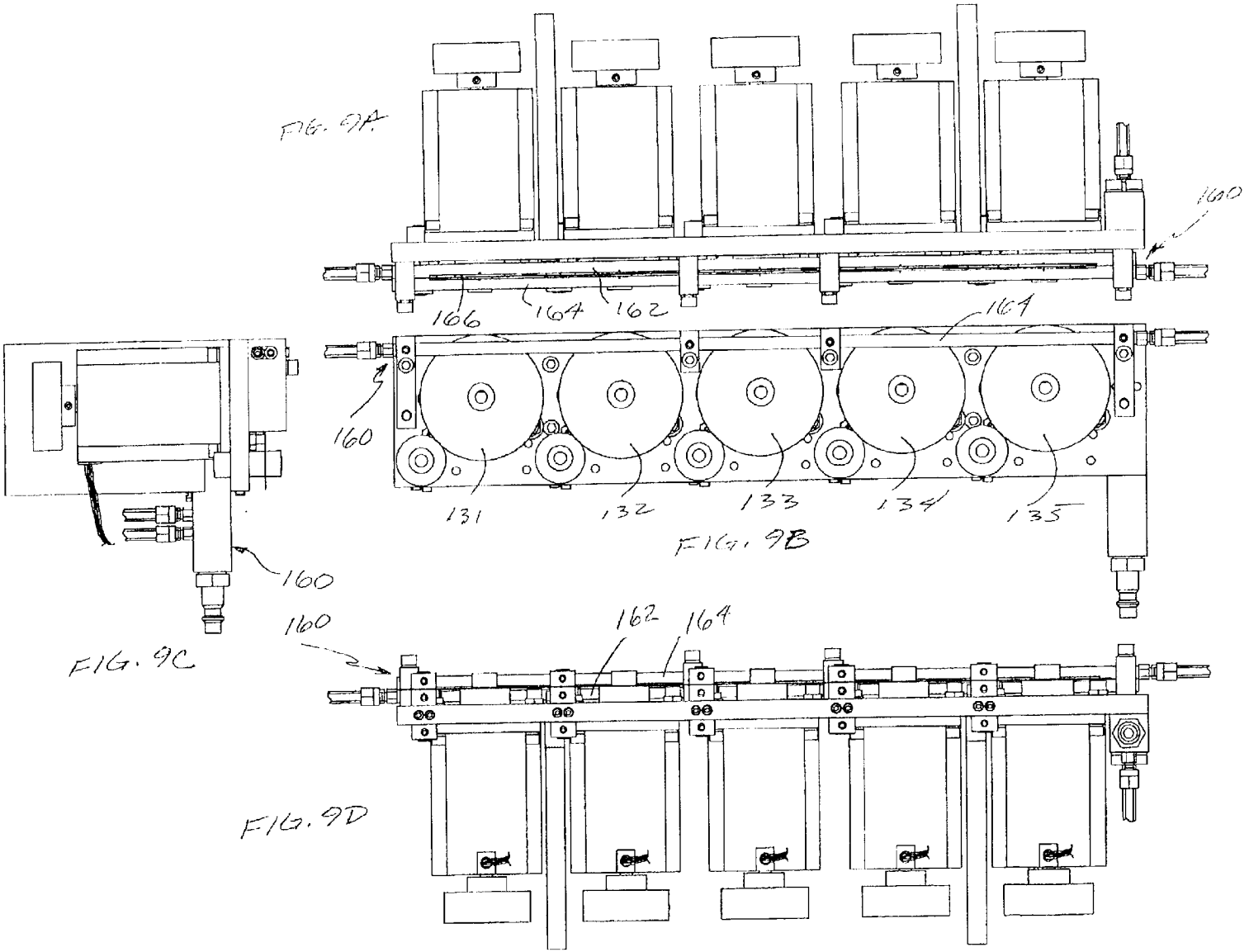
FIGS. 9A, 9B, 9C and 9D are bottom, front, side and top views, respectively, of a further assembled print head of the print head shown in FIGS. 6A, 7A and 8A.

Thicker blades can be utilized for carrying more paint than thinner blades. The blade is concentric and perpendicular to the motor shaft. Supporting mounts 140 and 142 are attached to the back side 144 of the frame member 116 that, as will be described herein, are used to attach the print head 100 to the printer carriage. In FIGS. 8A, 8B and 8C, a second blade 151–155 is mounted so that the teeth of the second blades 151–155 mesh perfectly with the teeth of the first blades 131–135, respectively. The second blades 151–155 may be of a smaller diameter than those of the first blades 131–135 to conserve space. Such a blade is available as part number 03289121 from MSC Industrial Supply Co. and described as a high speed steel jewelers saw with a 1.0 inch outer diameter, ¼ inch center hole, a thickness of 0.012 inch and 98 teeth. By calculating the tooth pitch of the first and second blades, the blades can be matched to ensure that the teeth will properly mesh. A slightly thicker second blade can be used to ensure complete cleaning of the interstices formed between blade teeth of the first blade. Different combinations of blades and tooth pitches can be also be utilized. For example, part number 03296233 HSS Jewelers Saws with a 2.5 inch diameter, a hole diameter of ½ inches, a 0.023 inch thickness, and 190 teeth can be used to interface with part number 03289329 HSS Jewelers Saw with a one inch diameter, a ¼ inch hole, a thickness of 0.032 inches and 76 teeth.

As previously discussed, the height of the second or cleaning blade is kept aligned with the first blade by the set screw 122. As will be described herein, the outer edges of the blades will be sandwiched between a set screw mounted on the opposite side. The cleaning blade rotates on a shaft 157 formed from water-hardening tool steel drill rod, letter size 'D', 0.246 inch diameter. Black oxide steel set screw type shaft collars 158 and 159 with bore diameters of ¼ inch, outside diameters of ½ inch, and widths of 5/16 inch are used to hold the cleaning blade 151 in position. The drill rod extends through an oblong hole in the frame member 116 plate. Utilizing two set screws 147 and 148, the second blade 151 is differentially held while the blade 151 can be moved relative to the oblong hole so that the blade 151 can be brought into substantially precise radial alignment with the blade 131. In addition, the differential set screws can be adjusted for blade wear. The collars 158 and 159 that sandwich the cleaning blade 151 are set so that there is about a 0.001 inch gap between the blade and the collars. This gap allows the blade 151 to rotate freely on the drill rod.

As shown in FIGS. 9A, 9B, 9C, and 9D, an air system, generally indicated at 160 is mounted to the frame member 116. The air system 160 is comprised of a pair of tubes 162 and 164, such as elongate brass tubes. The tubes 162 and 164 are held and supported in position to sandwich the blades 131–135 blades with the tubes 162 and 164 forming a gap 166 therein between. The gap 166 is formed by milling flat sides on the sides of the tubes 162 and 164 facing the blades to provide additional clearance.

At least five holes are drilled into the side of each tube, at least one for each blade. The holes are angled so that they point at the blade teeth closest to the media. The holes may be approximately 0.025 inch in diameter. An air supply feeds each of the tubes 162 and 164 at about 30 psig. The holes are positioned to blow air at the same point on opposite sides of each blade. The air supply provides constant pressure within the tubes 162 and 164 so as to provide continuously blowing air jets from the tubes 162 and 164, even when the blades are not rotating. As the blade is rotated, paint captured between adjacent teeth is brought to a point where the two air jets are focused. The captured paint is pulled from the blade and blown on to the media. The resulting air vector from the pair of air jets on each blade radially extends from the blade. Additional holes may be provided in the tubes 162 and 164 to serve to collimate the paint beam to provide a higher resolution and sharper edges on the media surface.

Figures 10A, 10B, 10C:
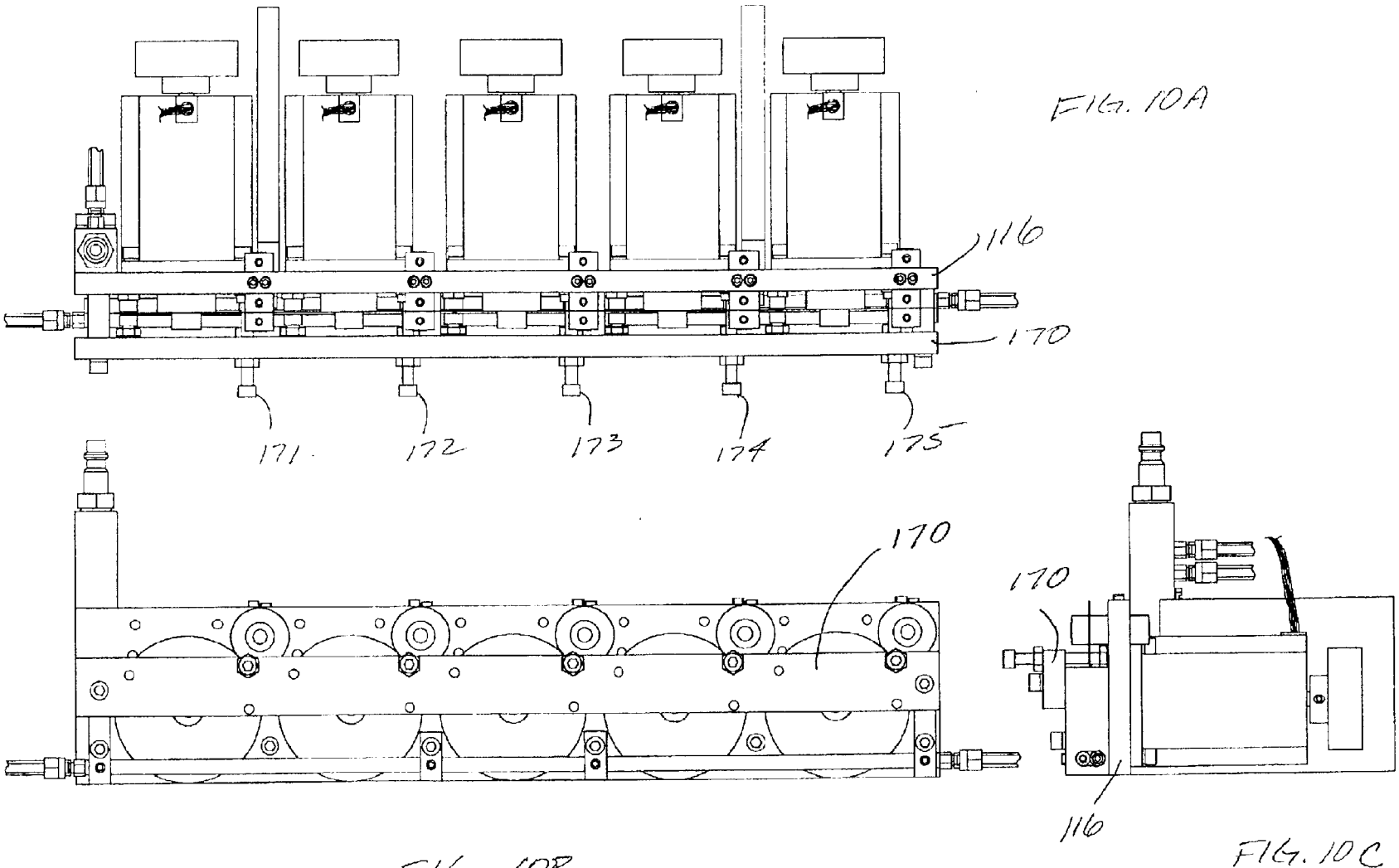
FIGS. 10A, 10B and 10C are top, front and side views, respectively, of a further assembled print head of the print head shown in FIGS. 6A, 7A, 8A and 9A.

Referring now to FIGS. 10A, 10B, and 10C, an alignment member 170, in this example, an elongate bar is added to the side opposite the frame member 116. The alignment member 170 is provided to attach threaded fasteners 171–175 thereto. The fasteners or screw ends are positioned opposite the scraper set screws attached to the frame member 116 as previously described. The screw ends scrape the opposite sides of each blade to remove any dried paint therefrom. The screw ends also provide alignment of the small and large blades as they sandwich the edges of the blades together.

Figures 11A, 11B, 11C:
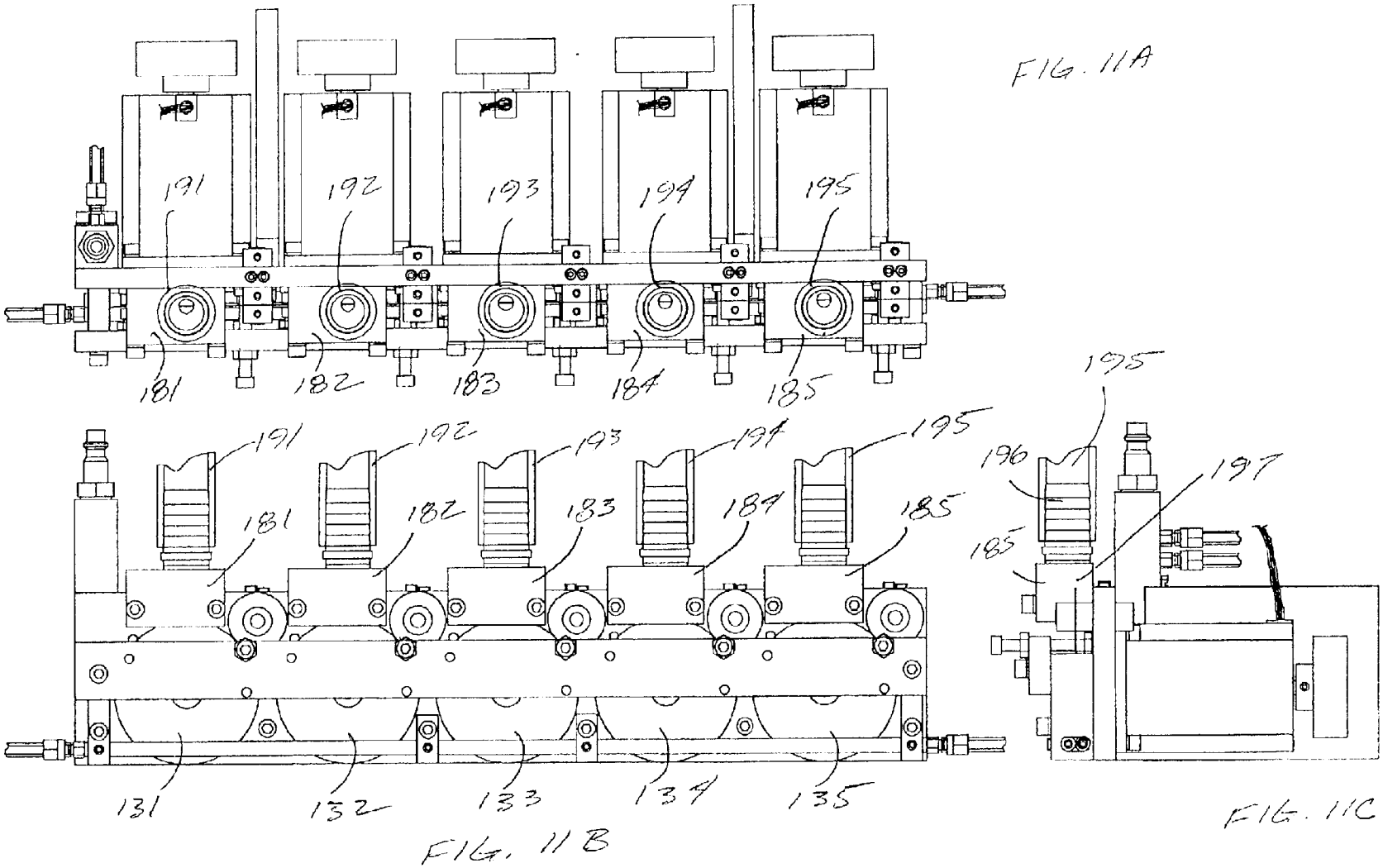

In FIGS. 11A, 11B and 11C, a paint dispenser/reservoir 181–185 is added to apply paint to each blade 131–135. In this example, the paint reservoirs 131–135 has a length of ¾ inch diameter vinyl tubing 191–195, respectively. The length is such to provide sufficient paint for a period of printing. It is also contemplated that a feeder mechanism can be added to the printer to add more paint to the reservoir automatically. Furthermore, a built-in software alarm can be provided to alert an operator to manually add more paint if paint is needed.

The tubes 191–195 fit on a nylon barbed fitting, such as fitting 196 shown in FIG. 11C, that is held in place with a set screw on an aluminum block 197 attached to the frame member 116. The only exit for paint in the block 197 is a slit or slot (as previously described) on the bottom side of the block 197. The slot is aligned with the first blade with the block 197 is mounted and the slot is cut so that the blade slices into the block slot. The slot may be machined so that there is perhaps only 0.001 inch of clearance between the blade and the slot and yet the blade will rotate freely as it is lubricated by the paint and the pumping action suspends the blade therein. The purpose of the slot is to cause the only paint exiting the slot to be that paint between the teeth of the blade. Dried paint on the surface of the slot furthers this purpose by forming a seal between the blade and the slot. The paint in the tube may be gravity fed or have a head pressure, for example one to eight inches or more.

Figure 12:
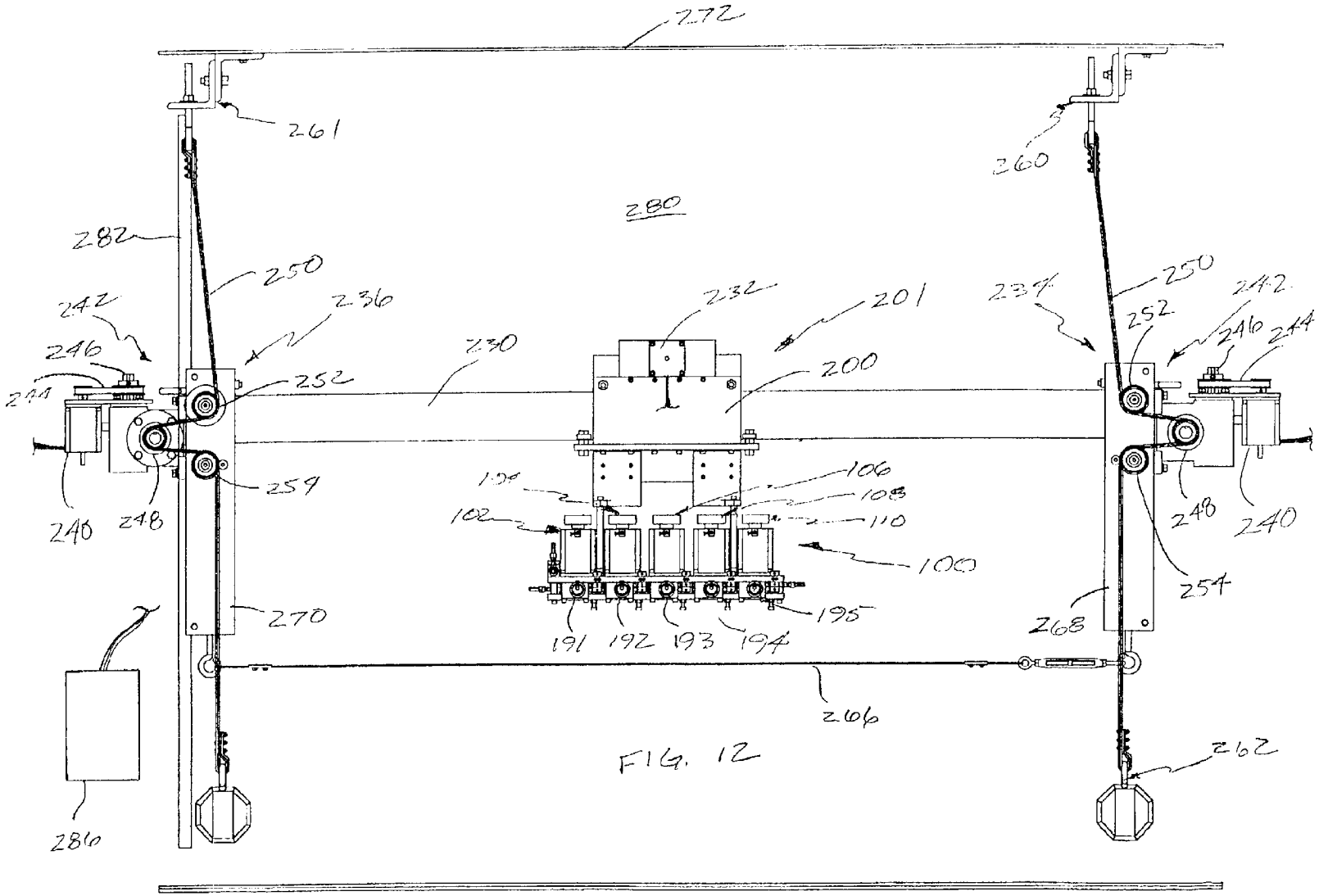
FIG. 12 is a front view of a wall printer assembly in accordance with the principles of the present invention.

As shown in FIG. 12, the print head 100 is mounted to a vertical flat bed printing mechanism, generally indicated at 201. The print head 100 may be mounted to print on a wall ceiling or floor. Only the various paint reservoirs comprised of vinyl tubing may need to be reoriented so that the fitting is positioned atop the block and the paint can flow by gravity into the block of each printing device. In the case where the paint is pressurized, such reorientation may not be needed as the paint pressure will maintain the paint within the block as needed for depositing on the blade. If desired, a mechanism for blowing or otherwise removing accumulated dried paint from the print head may be incorporated.

To selectively move the carriage 200 in an x-direction, the carriage 200 is mounted on a rectangular beam 230 in a track and trolley arrangement with a motor 232 provided to selectively control horizontal movement of the carriage 200 relative to the beam 230. The motor 232 may be a stepper or servo motor computer controlled to control the position of the carriage 200 relative to the beam 230. The motor 232 engages a timing belt (not visible) laid along the top of the beam 230 and secured at each end of the beam to the right and left frame members 268 and 270, respectively. The timing belt wraps around a pair of idlers and a timing belt sprocket in a manner similar to the sprockets 248, 252 and 254 with the motor 232 fixedly attached to the carriage 200. The beam 230 is secured between right and left vertical drive assemblies, generally indicated at 234 and 236, respectively. Each drive assembly 234 and 236 is comprised of a computer controlled drive motor 240 coupled to a drive system 242. A belt 244 couples the output of the drive motor 240 to the input 246 of the drive system 242. A worm gear (not shown) attached to the input 246 meshes with another gear (not shown) to rotate the drive sprocket 248. The drive sprocket 248 engages with the links of the chain 250 to raise and lower the beam 230 upon rotation of the drive sprocket 248. The motor 240 is either a stepper motor or a servo motor so as to allow precise control of the rotation of the shaft of the motor 240. By employing a micro-stepping device or gearing ratios between the output of the motor 240 and the sprocket 248, the vertical movement of the carriage 200 for each step of the motor 240 can be increased or decreased to likewise decrease or increase the line resolution of the printing as desired.

Idler sprockets 252 and 254 are provided to wrap the chain 250 around the drive sprocket 248 to provide engagement of a sufficient number of teeth of the drive sprocket 248 with links of the chain 250 so that disengagement of the drive sprocket 248 and the chain 250 is highly unlikely.

The chain 250 is tensioned between an upper mounting device 260 and a lower mounting device 262. Likewise, the right and left drive assemblies 234 and 236 are held in tensioned relative to one another with cable 266 coupled between the right and left frame members 268 and 270, respectively, to which the beam 230 and sprockets 252 and 254, and drive assembly 242 are mounted.

The drive right and left assemblies 234 and 236 move in unison up or down to precisely control the vertical position of the carriage 200 and thus the precise position of each printing device 191–195. It is also contemplated that the motor 240 could be mounted so as to directly drive the sprocket 248 without use of the on either the left assembly 236 or right assembly 234 or some other structure to lower the mass of the carriage 200. Such a motor would then drive a moveable chain or belt to position the carriage 200 at the desired location.

The print head 100 may be mounted to the carriage 200 at a slight angle allowing the paint colors within injectors or printing devices 191–195 to be applied in a predetermined overlapping order during bi-direction printing. For example, the first pass of the print head 100 over the media 280 might apply white paint to the first line. The second pass of the print head over the media might apply white paint to the second line and black paint to the first line over the white paint thereon. The third pass might apply white paint to the third line, black paint to the second line and cyan paint to the first line, an so on. Thus, by printing only four extra passes of the print head, the paint could always be printed in a predetermined order such as white on the bottom, black on top of the white, cyan on top of the black, then magenta and finally yellow, with the print head printing bi-directionally (i.e., right-to-left and left-to-right) on alternating lines so as to speed up overall printing.

Thus, to selectively move the carriage 200 in a z-direction, the entire beam 230, carriage 200 and right and left drive assemblies 234 and 236 are suspended with the chains 250 to an overhead structure such as a ceiling 272 with bracket assemblies 260 and 261.

In order to keep the carriage 200 from swaying either away from a print medium 280 or from side to side, a track 282 may be vertically oriented and secured to the a support structure, such as a wall or frame, to which the print medium 280 is permanently or temporarily secured. The track 282 may have a J-shaped cross-section into which a guide attached to the frame member 270 can engage and slide relative to thereto. Such a guide member may comprises a threaded bolt having its head retained by the track 282 and its shaft secured to the frame member 270. Accordingly, movement of the left assembly 236 is restricted from moving away from the print medium 280 or toward the right assembly 234. Similarly, a second track, having an opposite orientation to the track 282, may be secured to the wall to restrict movement of the right assembly from moving away from the print medium 280 or toward the left assembly 236 during printing. Those skilled in the art will recognize that other track and guide member assemblies could be employed to maintain the beam 230 in its appropriate horizontal position relative to the print medium 280, such as a single C-shaped track and retaining member arrangement.

In operation, the print medium 280 is attached to a wall or support frame and positioned between the wall or support frame and the carriage 200. A controller 286, such as a computer, sends signals to the individual motors of the printing devices 191–195 to control dispersion of paint as well as sends signals to the motors 232 and 240 to control relative position of the carriage 200 to the print medium 280. Such control of each color and the position of deposit of such color on the print medium allows for the formation of a digital image on the print medium 280. Thus, signals from the controller 286 are sent to the motors 232 and 240 which in turn cause movement of the sprockets 248 along the chains 150 corresponding to the desired vertical or z-direction position of the print head 100. Likewise, signals from the controller 286 are sent to the motor 232 which in turn drives the carriage 200 along the beam 230 corresponding to the desired horizontal or x-direction position of the print head 100. The controller 286 also individually controls each of the paint injectors 191–195 to deposit the desired color and quantity of paint on the print medium 280 at the desired location. Thus, the printable image size of the wall printer assembly of FIG. 12 is only limited by the length of the chains 250 and the length of the beam 230.

The present invention also contemplates that the print head 100 and/or individual printing devices 191–195 could be employed with other digital printing devices known in the art for digital painting purposes. For example, the print head 100 could be employed in a device where movement of the print head is along an x-axis while a roll of print medium, such as vinyl, building drape material or carpet, is selectively advanced relative to the print head 100 to affect movement along the y- or z-axis. With such a device, the size of print medium may only be limited by the size of the roll of print medium. Likewise, a rigid frame to which the print head, according to the present invention, can be mounted and upon which the print head could be selectively moved could also be employed to allow z- and x-direction movement or x- and y-direction movement of the print head, depending on the orientation of the frame.

Figures 13A, 13B:
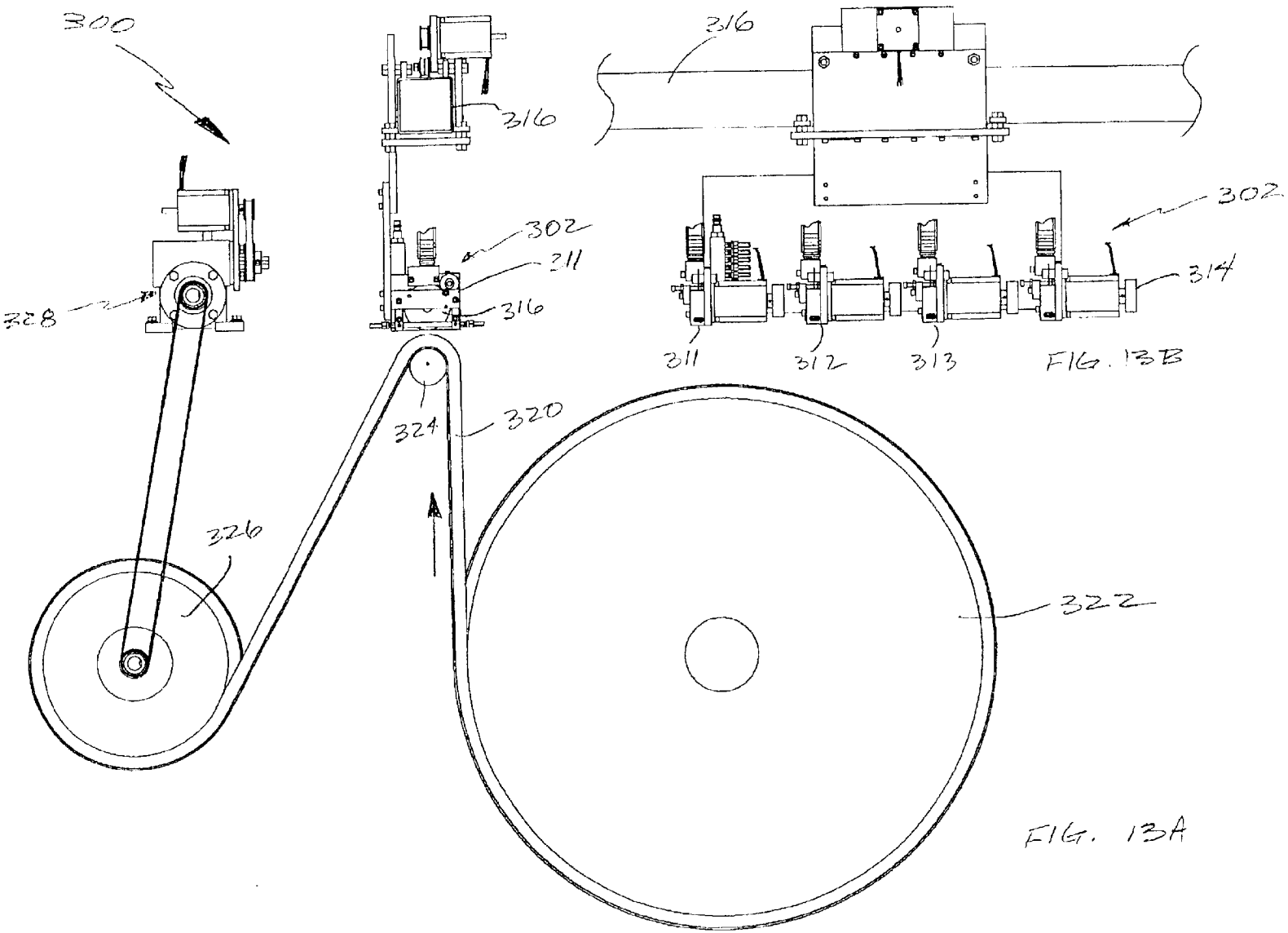
FIGS. 13A and 13B are side and partial front views of a carpet printer assembly in accordance with the principles of the present invention.

As shown in FIGS. 13A and 13B, a carpet printer assembly, generally indicated at 300, is illustrated. The carpet printer assembly is comprised of a print head, generally indicated at 302, in this case comprised of four printing devices 311–314. The print head 302 rides on a welded box beam 316. As compared with the print head 100 shown in FIG. 12, the printing devices 311–314 have be rotated ninety degrees such that the printing blades, such as blade 318, rotates in a direction in line with the direction of feeding of the carpet 320.

The carpet 320 is fed from a feed roll 322, drawn over a round mandrel 324 to expose the nap, and wound on a take-up roll 326 driven by a take-up drive assembly 328. The orientation of the blades 316 in line with the direction of the carpet feed, as indicated by the arrow, allows the blades 316 to print a wider area while keeping sharper resolution in the transverse direction, i.e., along the width of the carpet. When the fibers of the carpet nap close as it becomes flat after passing over the mandrel 324, the resolution is automatically enhanced in the roll or feed direction of the carpet 320.

As the print head 302 moves back and forth along the beam 316, a portion of a digital image is reproduced on the carpet 320. A transverse pass of the print head 302 occurs for each line of printing as needed to reproduce that portion of the digital image. The carpet 320 is then incrementally advanced to provide exposure of the next section of carpet 320 for receiving the next corresponding line of printing. The consistency of the distance or length of carpet advanced for each line of printing can be maintained by calculating the diameter changes, by an encoder on the nap spreading mandrel, or by a diameter measuring system which might be mechanical or optical. As such, the carpet printer 300 ensures that the width of each step of carpet 320 passing across the mandrel remains constant regardless of the diameter of the take-up roll 326.

By positioning the print head 302 further away from the carpet the carpet 320 at the location of printing, it is less likely that fibers released from the carpet 320 as it passes over the mandrel 324 will collect in the print head 302. Fiber or lint accumulation may be disposed of by various disposal means known in the art. For example, a vacuum system and/or an automatic cleaning system might be employed. Moreover, it may be desirable, depending upon the nature of the paint or ink and its relative drying time to providing a drying system to dry the paint before it is wound on the take-up roll 326 so as to prevent the paint or ink from depositing on the back of later layers of carpet on the roll 326 or causing such layers to stick to one another from the paint or ink. With fabric dies in particular, a steam system might be employed to set the fabric dyes prior to becoming rolled on the take-up roll 324.

While the print head devices of the present invention have been described as a single integrated unit, it is also contemplated that each of the individual printing devices and/or components thereof may be incorporated into a replaceable cartridge assembly, which includes various components as desired. For example, a replaceable cartridge could simply include the paint reservoir with a particular color and type of paint included. Unlike conventional ink jet type ink cartridges, once the reservoir emptied, the user could easily refill the reservoir with the desired paint. Likewise, the cartridge may include the paint reservoir and associated wheel in a snap in type assembly. In this example, the moving part (e.g., the wheel) and parts in which the wheel are in contact as the wheel rotates that may wear over time can be simply and easily replaced with a new cartridge. In addition, should the wheel and paint reservoir become clogged with paint, the wheel and paint reservoir cartridge could simply be replaced. Because of the simplicity of the components, however, and their relative availability and/or ease of manufacturing, such components of the present invention may be easily replaced without the use of a separate replaceable cartridge.

Figure 14:
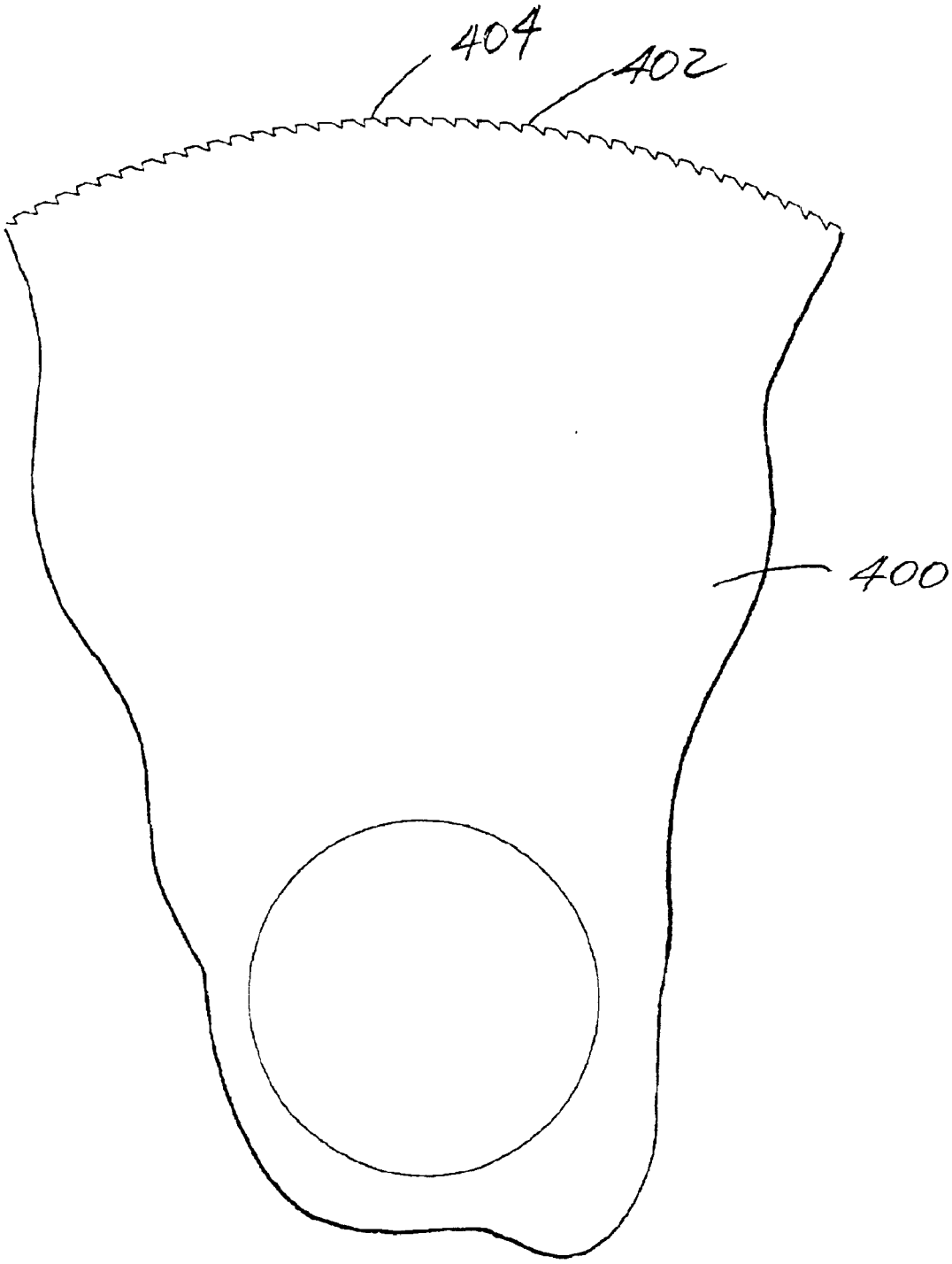
FIG. 14 is a partial side view of a second embodiment of a bladed wheel in accordance with the principles of the present invention.

As shown in FIG. 14, a blade 400, a portion of which is illustrated, may include teeth 402 that have had their tips removed to produce flattened top or outer edges 404. Because paint applied by the present invention tends to deposit on the blade 400, not only in the gaps between adjacent teeth 402 but also along a portion of the side surface of the blade 400 proximate the teeth 402, printing is more continuous. One might expect very digital type printing as paint is pulled from between the teeth in discrete droplets. As it happens, however, the paint, while primarily being held between teeth 402, also flows over a small radial surface of the blade 400. Because of this feature, it is also contemplated that a simple disk may be employed in accordance with the present invention.

Figure 15B:
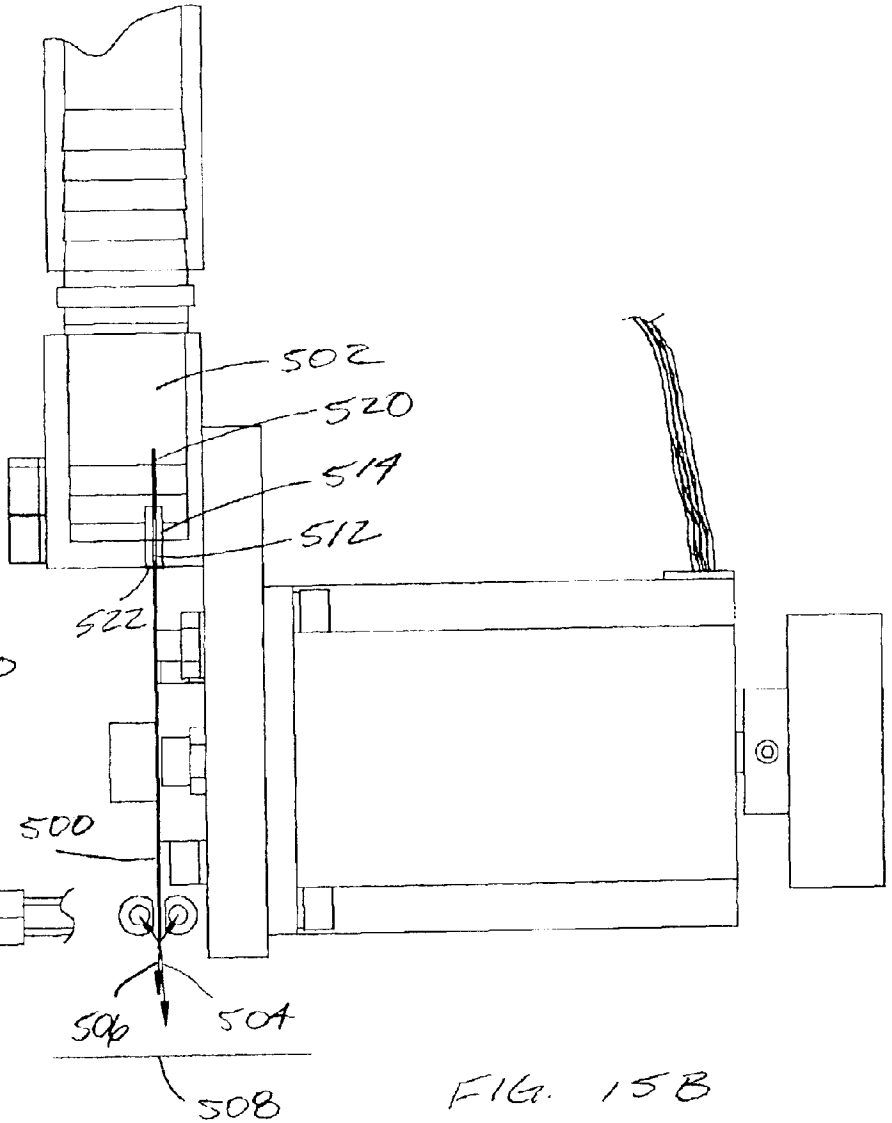
FIGS. 15A and 15B are front and side views of a second embodiment of a printing device in accordance with the principles of the present invention.
Figure 15A:
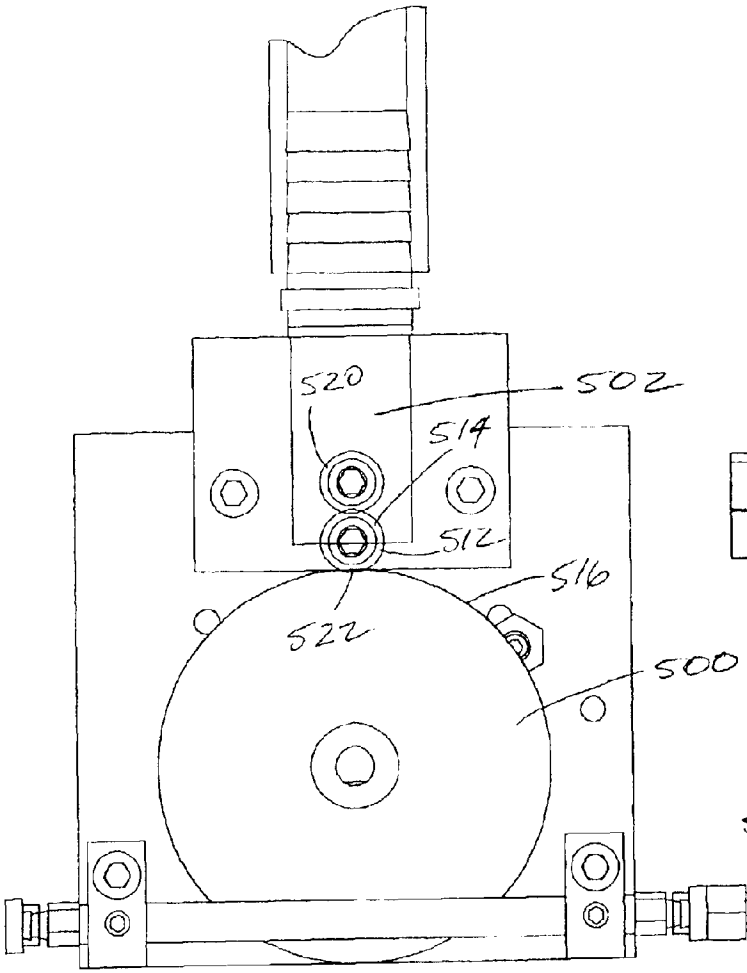

As shown in FIGS. 15A and 15B, a smooth edge wheel or disk 500 is used to transport paint 502 to the air jets 504 and 506 so as to be blown off to the media surface 508. The disk 500 rides in an annular or circumferential groove 512 formed in an application wheel or disk 514. The transfer disk 500 causes the grooved application disk 514 to rotate as the edge 516 of the transfer disk 500 rides on the bottom of the groove 512 and turns the grooved disk 514 as the transfer disk 500 rotates The groove 512 in the grooved disk 514 is slightly wider than the transfer disk 500 so as to cause paint within the groove 512 to be transferred to the sides of the transfer disk 500 proximate the outer edge 516 by wetting the edge 516 and using surface tension. A third wheel or disk 520, being thicker than the transfer disk 500, also rides within the groove 512 of the grooved disk 514. The third disk 520 has a width that is just slightly smaller than the width of the groove 512 while still allowing relatively easy rotation of the grooved disk 514. As the third disk 520 engages the groove 512 and rotates caused by rotation of the grooved wheel 514, the third disk 520 dislodges dried paint within the groove 512 of the grooved disk 514. Both the grooved disk 514 and the thicker disk 520 are contained with the reservoir 502 of paint and ride on axils attached to side walls thereof. The bottom edge 522 of the grooved disk 514 is exposed to the transfer disk 500 and the groove 512 and a portion of it is exposed to both the interior of the paint reservoir 514 and the exterior of the paint reservoir 514.

Figure 15D:
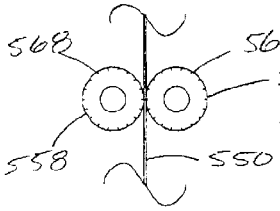
FIG. 15D is a partial top view of the application wheels of FIG. 15D.
Figure 15C:
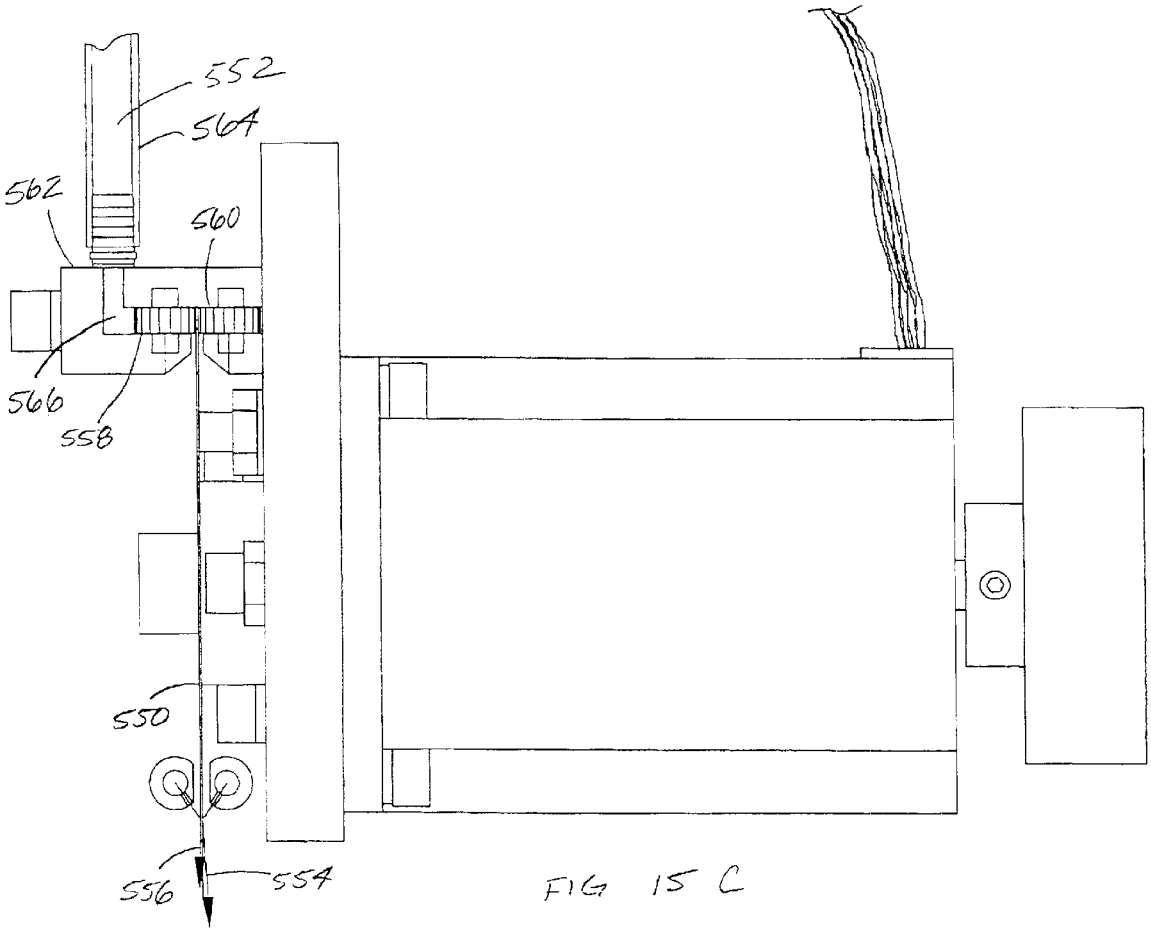
FIG. 15C is a front view of a third embodiment of a printing device in accordance with the principles of the present invention.

Likewise, as shown in FIGS. 15C and 15D, various other means of applying paint to a transfer disk 550 may be devised. For example, a smooth edge wheel or disk 550 is used to transport paint 552 to the air jets 554 and 556 so as to be blown off to the media surface 508. The disk 550 rotates between a pair of freely rotatable paint application wheels 558 and 560. The wheels 558 and 560 are held within a paint dispenser 562 coupled to a paint feed tube 564. The dispenser 562 defines a paint feed chamber 566 that is in fluid communication with both the feed tube 564 and the wheels 558 and 560 to allow paint to flow from the feed tube 564 to the wheels 558 and 560 as needed. Rotation of the transfer disk 550 causes rotation of the application wheels 558 and 560 with the rotation of the application wheels 558 and 560 causing paint to be applied to the outer edge of the transfer disk 550. Depending upon the position of the transfer disk 550 relative to the wheels 558 and 560, a strip of paint can be applied along the sides of the transfer disk 550 up to the thickness of the application wheels 558 and 560.

Both or one application wheels 558 and 560 may be contained with the dispenser 562 and ride on axils attached to side walls thereof. The outer circumferential surfaces 568 and 570 of the application wheels 558 and 560, respectively, are provided with a plurality of transversely extending grooves. These grooves provide small gaps in the wheels 558 and 560 for paint to reside prior to being applied to the transfer disk 550. The grooves also help to some extent to grip the sides of the transfer disk 550 so that the wheels 558 and 560 rotate as the transfer disk rotates 550. It should be noted that by using a single application wheel and one air jet, paint applied to a single side of the transfer disk could be adequately removed with a single air jet air jet.

Figure 16:
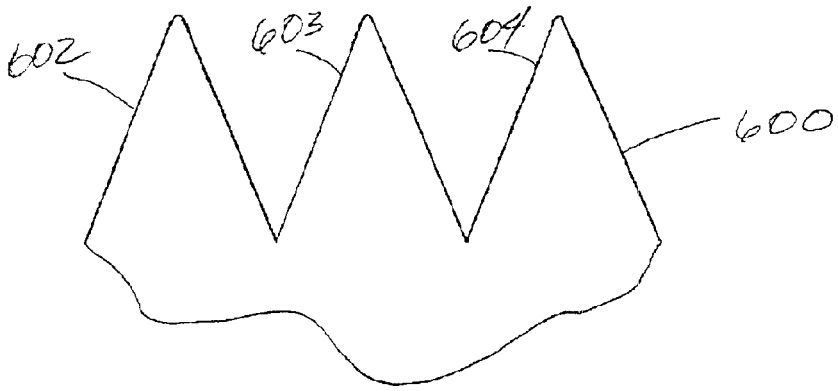
FIG. 16 is a partial side view of a third embodiment of a wheel in accordance with the principles of the present invention.

Further examples of transfer disk or wheel profiles are shown in FIGS. 16, 17, 18, 19 and 20. In FIG. 16, a gear-type wheel 600 is shown with the teeth 602, 603 and 604 performing similar to the bladed wheel described herein.

Figure 17:
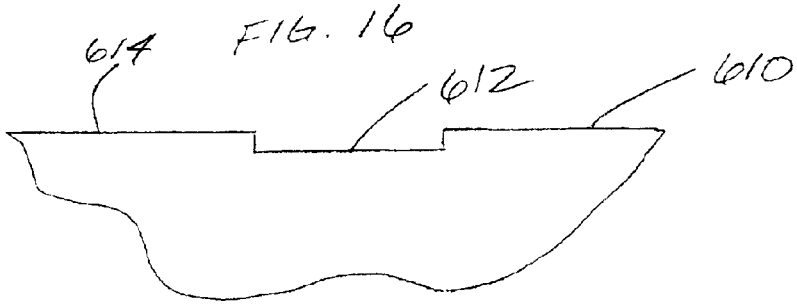
FIG. 17 is a partial side view of a fourth embodiment of a wheel in accordance with the principles of the present invention.

In FIG. 17, a wheel 610 with notches or transverse grooves 612 is illustrated. The grooves 612 provide places for paint to be deposited and held with surface tension on the outer edge 614 of the wheel 610. It should be noted that the groove 612 shown may be of any width from a width similar to the spacing of teeth on the blades described above to much smaller slits that very closely spaced.

Figure 18:
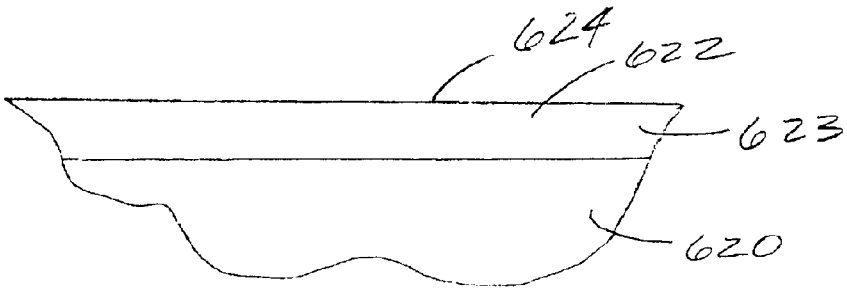
FIG. 18 is a partial side view of a fifth embodiment of a wheel in accordance with the principles of the present invention.

FIG. 18 shows a smooth edged disk or wheel 620 as described with reference to FIGS. 15A and 15B. As illustrated, the paint 622 is deposited in a band 623 proximate the outer edge 624 of the wheel 620.

Figure 19:
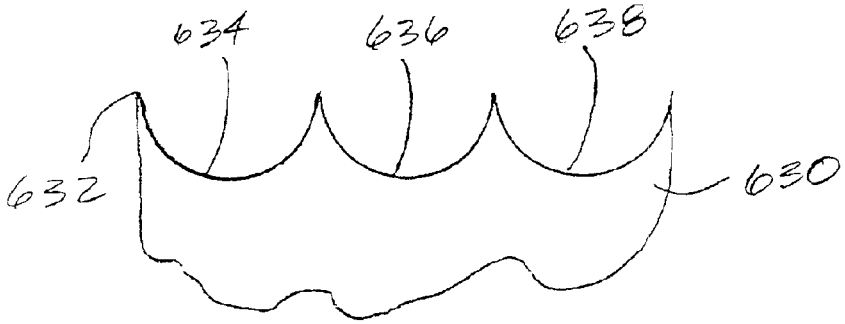
FIG. 19 is a partial side view of a sixth embodiment of a wheel in accordance with the principles of the present invention.

In FIG. 19, a wheel 630 has an outer edge 632 that defines a plurality of semicircular transverse grooves 634, 636 and 638 that form a serrated outer edge 632. Each channel or groove 624, 636 and 638 provides a pocket for holing paint as the wheel rotates through the air jet of the present invention.

Figure 20:
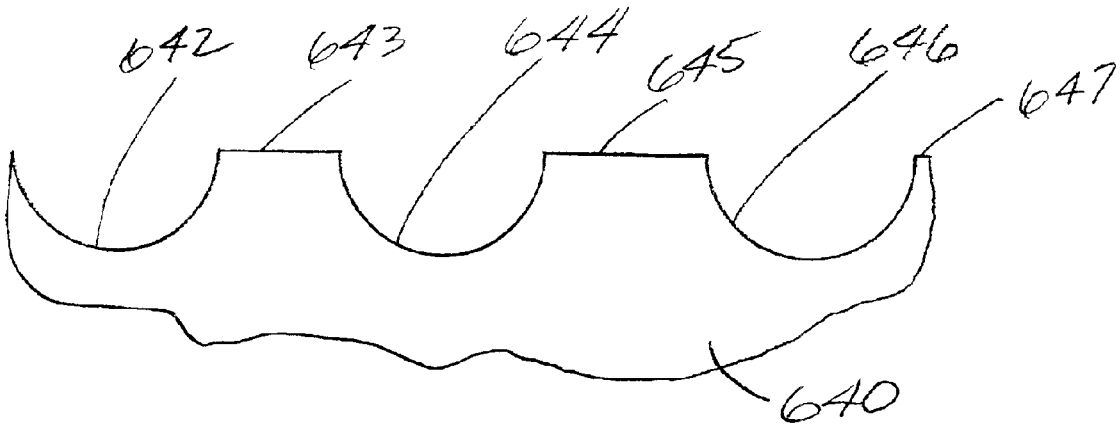
FIG. 20 is a partial side view of a seventh embodiment of a wheel in accordance with the principles of the present invention.

The wheel 640 of FIG. 20 is similar to that of FIG. 19 with the grooves 642, 644 and 646 spaced apart to provide edge plateaus 643 and 645 along the outer edge 647.

Likewise, as shown in FIGS. 21, 22, 23, 24 and 25, various cross-sectional profiles of wheels may be employed in accordance with the present invention, with each profile providing some additional benefit, such as ease of cleaning with the air jets or paint holding capability.

Figure 21:
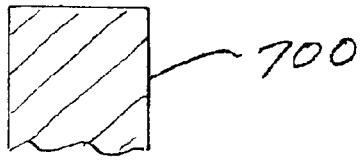
FIG. 21 is a partial cross-sectional side view of an eighth embodiment of a wheel in accordance with the principles of the present invention.
Figure 22:
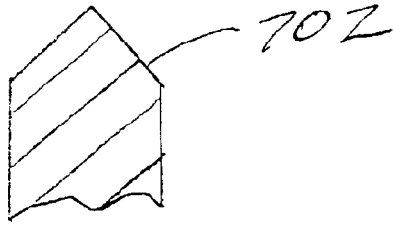
FIG. 22 is a partial cross-sectional side view of an ninth embodiment of a wheel in accordance with the principles of the present invention.
Figure 23:
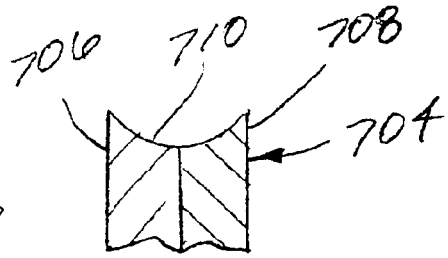
FIG. 23 is a partial cross-sectional side view of a tenth embodiment of a wheel in accordance with the principles of the present invention.

As shown in FIG. 21, the wheel 700 may have a simple rectangular profile. Likewise, a wheel 702 may have a peaked profile. As shown in FIG. 23, the desired profile of a wheel 704 may be achieved by combining a pair of wheels 706 and 708 abutted together to form the desired profile, in this case forming a circumferential channel 710 to hold paint therein.

Figure 24:
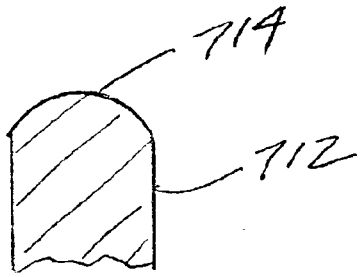
FIG. 24 is a partial cross-sectional side view of an eleventh embodiment of a wheel in accordance with the principles of the present invention.

In reverse, the wheel 712 of FIG. 24 provides a dome shaped outer edge 714 to facilitate paint removal therefrom as the air can easily flow over the surfaces of the outer edge 714 to pull paint therefrom.

Figure 25:
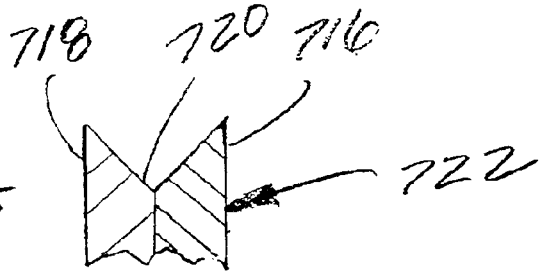
FIG. 25 is a partial cross-sectional side view of an twelfth embodiment of a wheel in accordance with the principles of the present invention.

Finally, as shown in FIG. 25, a pair of wheels 716 and 718 can be combined to form a circumferential V-shaped groove 720 extending around the wheel 722.

Each of the forgoing cross-sectional profiles shown in FIGS. 21–25 could be incorporated with any of the blade profiles shown in FIGS. 16–20 or the blade configurations previously described.

It should also be noted that while one and three nozzle or orifice configurations have been illustrated and discussed, various other nozzle or orifice configurations may be equally effective for removing the paint from the wheel while reducing spray, spattering or divergence of the paint within the air stream and are thus contemplated within the scope of the present invention.

Spatter created by the paint impacting the print medium and by turbulent flow of air around the wheel may be controlled by controlling the pressure of air supplied to the orifice, and thus the velocity of the air stream. For example, an air pressure of approximately 10 psi would be sufficient to direct some paints and dyes toward the print medium and substantially clean the wheel while minimizing spatter. Higher pressures of 80 psi or more may have equal utility depending on the distance of the wheel from the print medium, the quantity of paint on the wheel, and the diameter of the air jet orifices.

It should be noted that having white paint added to the mix of colors, however, allows painting on any color of print medium. It is contemplated, however, that more or fewer paint injectors may be included with various colors contained therein depending on the desired colors of print produced.

Those of skill in the art will appreciate, after an understanding of the present invention, that various modifications to the present invention may be made without departing from the spirit and scope thereof. For example, the wheel or blade may have various configurations in addition to those specifically described. Moreover, there may be various ways of applying or depositing paint onto the wheel or blade.

In general, the invention comprises digitally controlling the rotation of a wheel in which the advancement causes paint or other liquid material to be deposited on the wheel. Once at least partially coated, further rotation of the wheel moves the liquid coated portion in front of a stream of fluid, such as air, to remove the liquid from the wheel and deposit it onto a print medium. It is noted that while references are made to paint in the specification and claims, the term is intended to encompass, inks, dyes, and any other liquid pigmented material that can be deposited on a surface for printing or painting purposes. Furthermore, the present invention clearly has application in other fields where liquid materials are to be applied to a surface at discrete and relatively controlled locations. In addition, it is to be understood that the above-described embodiments are only illustrative of the application of the principles of the present invention. Numerous modifications and alternatives may be devised by those skilled in the art, including combinations of the various embodiments, without departing from the spirit and scope of the present invention. The appended claims are intended to cover such modifications, alternative arrangements, and combinations.

What is claimed is:

1. An apparatus for depositing a liquid on a medium, comprising:

at least one wheel having an outer edge selectively rotatable by a motor;

a liquid dispenser for depositing a quantity of liquid on said wheel proximate said outer edge; and at least one air jet positioned proximate said outer edge for directing a flow of air at said outer edge, said flow of air removing at least a portion of said quantity of liquid and carrying the at least a portion of said quantity of liquid toward the print medium as said wheel rotates through said flow of air.

2. The apparatus of claim 1, wherein said outer edge of said wheel is comprised of a plurality of teeth.

3. The apparatus of claim 1, wherein said motor comprises one of a stepper motor and a servo motor electronically controlled by a computer for selectively controlling the rotation of said at least one wheel and thus the quantity of paint removed by said at least one air jet.

4. The apparatus of claim 1, wherein said liquid dispenser comprises a reservoir in fluid communication with said outer edge for depositing a quantity of liquid on said outer edge.

5. The apparatus of claim 4, wherein said reservoir comprises a base member having a slot therein in fluid communication with an interior of said reservoir for receiving an edge of said wheel.

6. The apparatus of claim 5, wherein said wheel fits at least partially within said slot in close tolerance thereto to allow the wheel to rotate within the slot with the slot cleaning the side surfaces of the wheel.

7. The apparatus of claim 1, wherein said at least one air jet comprises a first air jet positioned on a first side of said wheel and a second air jet positioned on a second side of said wheel, said first and second air jets oriented toward a position proximate said outer edge of said wheel at an angle thereto to remove liquid on said wheel and direct the liquid away from the outer edge of the wheel.

8. The apparatus of claim 7, wherein said first and second air jets each comprise primary and secondary air jets, said primary air jets positioned to remove liquid from said wheel in a direction radially extending from the center of said wheel and said secondary air jets angled toward said primary air jet to focus said liquid in line with the direction of flow of the primary air jets.

9. The apparatus of claim 1, wherein said wheel is coupled to a shaft of the motor.

10. The apparatus of claim 1, wherein said liquid dispenser comprises at least one second wheel rotatable by said at least one wheel, said at least one second wheel in fluid communication with a liquid reservoir and engaging said outer edge of said at least one wheel.

11. The apparatus of claim 10, wherein said at least one second wheel comprises an annular groove for receiving said outer edge of said at least one wheel, wherein said annular groove of said at least one second wheel receives liquid from said liquid dispenser and rotation of said at least one wheel allows liquid within said annular groove to be deposited on said outer edge of said at least one wheel.

12. The apparatus of claim 10, wherein said at least one second wheel comprises a serrated outer edge.

13. The apparatus of claim 10, wherein said at least one second wheel comprises a pair of wheels oriented approximately ninety degrees to said at least one first wheel and each of said pair of wheels engaging opposite sides of said at least one first wheel proximate said outer edge.

14. The apparatus of claim 1, wherein said liquid is comprised of at least one of paint, ink, die, etchant, solvent, oil, acrylic, and polyurethane.

15. The apparatus of claim 2, further comprising at least one second wheel having teeth configured to match the pitch of the teeth on said at least one wheel, wherein rotation of said at least one wheel causes rotation of said at least one second wheel and wherein said at least one second wheel cleans the teeth of the at least one wheel.

16. The apparatus of claim 15, further comprising at least one scraper for removing material cleaned by said at least one second wheel.

17. An apparatus for depositing a liquified material on a surface, comprising:

stream means for providing a fluid stream;

wheel means for advancing a material disposed on at least an outer edge thereof through said stream means, said stream means oriented for removing said material from said wheel means;

application means for applying said material onto said wheel means; and control means for selectively rotating said wheel means relative to said stream means and thus controlling the quantity of material removed from said wheel means by said stream means.

18. The apparatus of claim 17, wherein said wheel means comprises at least one wheel having an outer edge, said application means comprises a dispenser for depositing a quantity of material on said wheel proximate said outer edge, said stream means comprises at least one air jet positioned proximate said outer edge for removing at least a portion of said quantity of material and directing the material toward a medium as said wheel rotates through said at least one air jet, and said control means comprises at least one of a stepper motor and a servo motor.

19. The apparatus of claim 18, wherein said outer edge of said wheel is comprised of a plurality of teeth.

20. The apparatus of claim 18, wherein said control means further comprises a computer for selectively controlling the rotation of said at least one wheel and thus the quantity of paint removed by said at least one air jet.

21. The apparatus of claim 18, wherein said dispenser comprises a reservoir in fluid communication with said outer edge for depositing a quantity of liquid on said outer edge.

22. The apparatus of claim 21, wherein said reservoir comprises a base member having a slot therein in fluid communication with an interior of said reservoir for receiving an edge of said wheel.

23. The apparatus of claim 22, wherein said wheel fits at least partially within said slot in close tolerance thereto to allow the wheel to rotate within the slot with the slot cleaning the side surfaces of the wheel.

24. The apparatus of claim 18, wherein said at least one air jet comprises a first air jet positioned on a first side of said wheel and a second air jet positioned on a second side of said wheel, said first and second air jets oriented toward a position proximate said outer edge of said wheel at an angle thereto to remove liquid on said wheel and direct the liquid away from the outer edge of the wheel.

25. The apparatus of claim 24, wherein said first and second air jets each comprise primary and secondary air jets, said primary air jets positioned to remove liquid from said wheel in a direction radially extending from the center of said wheel and said secondary air jets angled toward said primary air jet to focus said liquid in line with the direction of flow of the primary air jets.

26. The apparatus of claim 18, wherein said wheel is coupled to a shaft of the motor.

27. The apparatus of claim 18, wherein said liquid dispenser comprises at least one second wheel rotatable by said at least one wheel, said at least one second wheel in fluid communication with a liquid reservoir and engaging said outer edge of said at least one wheel.

28. The apparatus of claim 27, wherein said at least one second wheel comprises an annular groove for receiving said outer edge of said at least one wheel, wherein said annular groove of said at least one second wheel receives liquid from said liquid dispenser and rotation of said at least one wheel allows liquid within said annular groove to be deposited on said outer edge of said at least one wheel.

29. The apparatus of claim 27, wherein said at least one second wheel comprises a serrated outer edge.

30. The apparatus of claim 27, wherein said at least one second wheel comprises a pair of wheels oriented approximately ninety degrees to said at least one first wheel and each of said pair of wheels engaging opposite sides of said at least one first wheel proximate said outer edge.

31. The apparatus of claim 18, wherein said liquid is comprised of at least one of paint, ink, die, etchant, solvent, oil, acrylic, and polyurethane.

32. The apparatus of claim 19, further comprising at least one second wheel having teeth configured to match the pitch of the teeth on said at least one wheel, wherein rotation of said at least one wheel causes rotation of said at least one second wheel and wherein said at least one second wheel cleans the teeth of the at least one wheel.

33. The apparatus of claim 32, further comprising at least one scraper for removing material cleaned by said at least one second wheel.

34. An apparatus for digital painting, comprising:

a frame;

a plurality of printing units secured to said frame, each of said printing units comprising:

at least one wheel having an outer edge selectively rotatable by a motor;

a liquid dispenser for depositing a quantity of liquid on said wheel proximate said outer edge;

at least one air jet positioned proximate said outer edge for removing at least a portion of said quantity of liquid and directing the liquid toward the print medium as said wheel rotates through said at least one air jet.

35. The apparatus of claim 34, wherein said outer edge of said wheel is comprised of a plurality of teeth.

36. The apparatus of claim 34, wherein each of said plurality of printing units further comprises a stepper motor electronically controlled by a computer for selectively controlling the rotation of said at least one wheel and thus the quantity of liquid removed by said at least one air jet.

37. The apparatus of claim 34, wherein said liquid dispenser comprises a reservoir in fluid communication with said outer edge for depositing a quantity of liquid on said outer edge.

38. The apparatus of claim 37, wherein each of said reservoirs contain a different color of paint.

39. The apparatus of claim 34, further comprising a support structure comprises a left support assembly and a right support assembly, said frame being mounted and moveable between said left support assembly and said right support assembly.

40. The apparatus of claim 39, wherein said right and left support assemblies are configured to allow movement of said frame along said right and left support assemblies.

41. The apparatus of claim 37, wherein said reservoir comprises a base member having a slot therein in fluid communication with an interior of said reservoir for receiving an edge of said wheel.

42. The apparatus of claim 41, wherein said wheel fits at least partially within said slot in close tolerance thereto to allow the wheel to rotate within the slot with the slot cleaning the side surfaces of the wheel.

43. The apparatus of claim 34, wherein said at least one air jet comprises a first air jet positioned on a first side of said wheel and a second air jet positioned on a second side of said wheel, said first and second air jets oriented toward a position proximate said outer edge of said wheel at an angle thereto to remove liquid on said wheel and direct the liquid away from the outer edge of the wheel.

44. The apparatus of claim 43, wherein said first and second air jets each comprise primary and secondary air jets, said primary air jets positioned to remove liquid from said wheel in a direction radially extending from the center of said wheel and said secondary air jets angled toward said primary air jet to focus said liquid in line with the direction of flow of the primary air jets.

45. The apparatus of claim 34, wherein said wheel is coupled to a shaft of the motor.

46. The apparatus of claim 34, wherein said liquid dispenser comprises at least one second wheel rotatable by said at least one wheel, said at least one second wheel in fluid communication with a liquid reservoir and engaging said outer edge of said at least one wheel.

47. The apparatus of claim 46, wherein said at least one second wheel comprises an annular groove for receiving said outer edge of said at least one wheel, wherein said annular groove of said at least one second wheel receives liquid from said liquid dispenser and rotation of said at least one wheel allows liquid within said annular groove to be deposited on said outer edge of said at least one wheel.

48. The apparatus of claim 46, wherein said at least one second wheel comprises a serrated outer edge.

49. The apparatus of claim 46, wherein said at least one second wheel comprises a pair of wheels oriented approximately ninety degrees to said at least one first wheel and each of said pair of wheels engaging opposite sides of said at least one first wheel proximate said outer edge.

50. The apparatus of claim 34, wherein said liquid is comprised of at least one of paint, ink, die, etchant, solvent, oil, acrylic, and polyurethane coating.

51. The apparatus of claim 35, further comprising at least one second wheel having teeth configured to match the pitch of the teeth on said at least one wheel, wherein rotation of said at least one wheel causes rotation of said at least one second wheel and wherein said at least one second wheel cleans the teeth of the at least one wheel.

52. The apparatus of claim 51, further comprising at least one scraper for removing material cleaned by said at least one second wheel.

* * * * *